US006768409B2

(12) United States Patent
Inoue et al.

(10) Patent No.: US 6,768,409 B2
(45) Date of Patent: Jul. 27, 2004

(54) MAGNETIC DEVICE, METHOD FOR MANUFACTURING THE SAME, AND POWER SUPPLY MODULE EQUIPPED WITH THE SAME

(75) Inventors: Osamu Inoue, Hirakata (JP); Hiroyuki Handa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 82 days.

(21) Appl. No.: 10/229,624

(22) Filed: Aug. 27, 2002

(65) Prior Publication Data

US 2003/0048167 A1 Mar. 13, 2003

(30) Foreign Application Priority Data

Aug. 29, 2001 (JP) ..... 2001-259793
Nov. 2, 2001 (JP) ..... 2001-338242

(51) Int. Cl.[7] ..... H01F 5/00; H01F 7/06
(52) U.S. Cl. ..... 336/200; 336/232; 29/602.1
(58) Field of Search ..... 336/200, 223, 336/232; 29/602.1, 606

(56) References Cited

U.S. PATENT DOCUMENTS 4,959,631 A 9/1990 Hasegawa et al.
5,074,929 A * 12/1991 Bradley et al. ..... 148/101
5,471,736 A * 12/1995 Griebeler ..... 29/609
5,900,797 A 5/1999 Dougauchi et al. ..... 336/200
6,067,002 A 5/2000 Fujino et al. ..... 336/200
6,264,777 B1 7/2001 Yamaguchi ..... 156/89.12
6,417,755 B1 * 7/2002 Liu et al. ..... 336/200
6,501,363 B1 * 12/2002 Hwu et al. ..... 336/200
6,594,885 B2 * 7/2003 Abdel-Tawab et al. ..... 29/606
6,651,309 B2 * 11/2003 Gay et al. ..... 29/596
6,658,724 B2 * 12/2003 Nakano et al. ..... 29/609

FOREIGN PATENT DOCUMENTS

| | | |
|---|---|---|
| EP | 1 022 750 | 7/2000 |
| GB | 1 604 531 | 12/1981 |
| JP | 53-136538 | 10/1978 |
| JP | 3-284808 | 12/1981 |
| JP | 58-133906 | 9/1983 |
| JP | 59-23708 | 2/1984 |
| JP | 59-67909 | 5/1984 |
| JP | 61-136213 | 6/1986 |
| JP | 1-157508 | 6/1989 |
| JP | 1-310518 | 12/1989 |
| JP | 6-342725 | 12/1994 |
| JP | 9-270334 | 3/1996 |

* cited by examiner

*Primary Examiner*—Anh Mai
(74) *Attorney, Agent, or Firm*—Merchant & Gould P.C.

(57) ABSTRACT

A magnetic device includes a sheet-type coil including a planar conductive coil and an insulating substance; and a sheet-type first magnetic member disposed on at least one of upper and lower surfaces of the sheet-type coil, where a magnetic permeability of the insulating substance is smaller than a magnetic permeability of the first magnetic member. The magnetic device preferably includes a second magnetic member provided at a predetermined area of the sheet-type coil, the second magnetic member being made of a resin containing a magnetic powder and having a permeability larger than the insulating substance and smaller than the first magnetic member. The predetermined area is at least one position selected from a center portion and a peripheral portion of the sheet-type coil where a conductor constituting the planar conductive coil is not present. Further, a power supply module of the present invention includes this magnetic device according to the present invention.

27 Claims, 16 Drawing Sheets

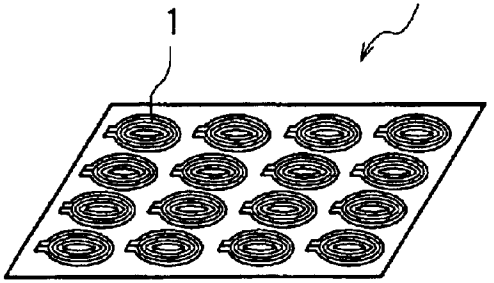
FIG. 15A
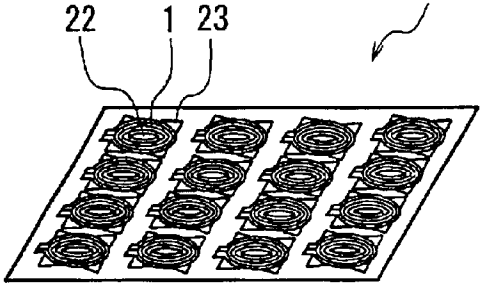
FIG. 15B
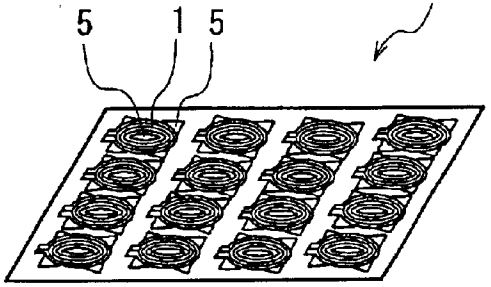
FIG. 15C
FIG. 15D
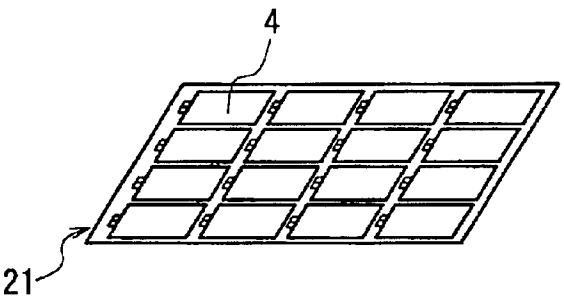
FIG. 15E
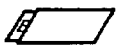
FIG. 15F

MAGNETIC DEVICE, METHOD FOR MANUFACTURING THE SAME, AND POWER SUPPLY MODULE EQUIPPED WITH THE SAME

BACKGROUND OF THE INVENTION

1. Field of the Invention

The present invention relates to an ultra-thin magnetic device used for an inductor, a choke coil, a transformer and the like in electric equipment, and to a method for manufacturing the magnetic device and a power supply module equipped with the magnetic device.

2. Related Background Art

In recent years, with the general trend toward smaller and thinner electric equipment, there is a strong demand for smaller and thinner components, devices, power supplies and the like used in such electric equipment. Particularly, in the field of mobile equipment, the demand for making them thinner becomes stronger than that for making them smaller. Meanwhile, LSIs such as a CPU are now increasing in speed and density, and in some cases a large current is fed to a power supply circuit provided for such LSIs. Thus, a magnetic device used as an inductor or the like in the power supply circuit for such LSIs is required for: being constituted with a coil made of a conductor having low resistance, which realizes a low heating value; and suppressing a decrease in the inductance value due to direct current (DC) superimposition (i.e., having a favorable DC superimposition property). In addition, since operation frequencies tend to be higher, a small loss at high frequencies also is required. Furthermore, since it is required strongly to reduce the cost of components, elements constituting the components in a simple shape have to be assembled in a simple process. To sum up, it is required to supply an inexpensive magnetic device that is as small and thin as possible, which is operable with a large current and at high frequencies. Among components used in the power supply circuit, a magnetic device used as an inductor or the like is the thickest. Therefore, also in order to make the power supply itself thinner, the magnetic device is demanded strongly to be made thinner.

Generally, the miniaturization of magnetic devices decreases a cross-sectional area of the magnetic path, thus decreasing an inductance value of the device. As means for improving the property of such a miniaturized magnetic device (i.e., for increasing an inductance value), JP 53(1978)-136538 U and JP 61(1986)-136213 A, for example, suggest a magnetic device having a closed magnetic path structure formed by winding coils around a drum-shaped core with flanges made of ferrite or the like and by filling inside of the flanges with a mixture of a magnetic powder and a resin. This configuration can eliminate a bobbin, which is used with coils usually, and therefore a cross-sectional area of the magnetic path can be increased. In addition, by virtue of the closed magnetic path structure, the inductance value can be increased. In this way, properties of the magnetic device can be improved. However, the magnetic device with such a configuration has the following problems: that is, since this configuration aims to miniaturize the magnetic device, a device with a sufficient small thickness cannot be realized. In addition, low-permeability resin layers adhered to the outer surface of the magnetic device increase a leakage flux, resulting in insufficient properties. Furthermore, a special technology is necessary for shaping the resin layers adhered to the outer surface of the magnetic device. Although an inductor manufactured with such a technology and having a size of, for example, about 2×1×1 mm is now on the market, the coil constituting this inductor has large DC resistance.

In order to achieve a coil of low DC resistance and a large inductance value, the coil has to be manufactured with a thick wire and the number of turns also has to be increased. At the same time, in order to make a device thin, the thickness of the coil has to be made approximately 1 mm or less, but a cross-sectional area of the magnetic path has to be increased to some extent. To this end, it is preferable that the coil is wound not in solenoid form but in planar spiral form. In order to secure the space for accommodating the coil satisfying these conditions, the size of the device has to be increased to 2 to 10 mm square. However, such a thin configuration having a large area/thickness ratio increases a leakage flux, which makes the realization of a large inductance value difficult.

To cope with this problem, JP 58(1983)-133906 U, JP 59(1984)-67909 U, JP 1(1989)-157508 A, JP 1(1989)-310518 A and JP 3(1991)-284808 A, for example, suggest a configuration where a conductive coil wound in planar spiral form are sandwiched between ferromagnetic layers arranged on the upper and lower surfaces of the conductive coil with an insulating layer intervening therebetween. With this configuration, since high-permeability magnetic elements are disposed on the upper and lower surfaces of the conductive coil, a leakage flux therefrom can be made relatively small in the even thin configuration, which can realize a large inductance value. However, in the case of this configuration, the conductive coil is exposed at the side of the magnetic device, and therefore the device has a problem concerning the reliability. In addition, this configuration is uncertain as to a method for providing the adhesiveness between the respective parts.

As a magnetic device to cope with this problem, JP 59(1984)-23708 U and JP 6(1994)-342725 A suggest a configuration where a conductive coil wound in planar spiral form is embedded in a paste containing a mixture of a ferrite powder and a resin and ferrite boards are attached to the upper and lower surfaces of the paste. Also, JP 9(1997)-270334 A suggests a configuration where a conductive coil wound in planar spiral form is embedded in a resin containing a magnetic powder (hereinafter referred to as "magnetics containing resin") and thin metallic magnetic elements are attached to the upper and lower surface of the resin. With these configurations, since the conductive coils are embedded in the resin, the problem of the conductive coil being exposed at the side of the device does not occur. In addition, the ferrite boards and the thin metallic magnetic elements, which are disposed above and below the coil, can be bonded to the conductive coil embedded in a resin by curing the resin.

However, the magnetic device disclosed in JP 6(1994)-342725 A has a configuration where the conductive coil itself is embedded completely in the magnetics containing resin, which means that the magnetics containing resin is present between adjacent turns of the conductive coil and around the conductive coil. Therefore, magnetic paths functioning as a short path, which traverse within the conductor constituting the conductive coil or traverse across adjacent turns, are likely to occur, compared with the magnetic paths as what should be, which extend along the outer region of the conductive coil. Such an increase in the magnetic flux traversing in the conductor constituting the conductive coil and traversing across the conductors causes problems in that a magnetic loss is increased at high frequencies and at the same time the inductance value is decreased.

Furthermore, the magnetic devices disclosed in the above-mentioned publications have to be manufactured on a one-by-one basis, or with a vacuum process such as vacuum evaporation and sputtering, and therefore have problems of poor mass productivity and a high manufacturing cost.

SUMMARY OF THE INVENTION

A magnetic device according to the present invention includes a sheet-type coil including a planar conductive coil and an insulating substance; and a first magnetic member in sheet form disposed on at least one of upper and lower surfaces of the sheet-type coil. In this device, a magnetic permeability of the insulating substance is smaller than a magnetic permeability of the first magnetic member.

A method for manufacturing a magnetic device according to the present invention includes the steps of preparing a sheet-type coil including a planar conductive coil and an insulating substance; and then disposing a first magnetic member in sheet-form having a magnetic permeability larger than that of the insulating substance on at least one of upper and lower surfaces of the sheet-type coil.

A power supply module according to the present invention includes a wiring board and the magnetic device according to the present invention, which are connected electrically with each other.

BRIEF DESCRIPTION OF THE DRAWINGS

FIGS. 15A to 15F are perspective views showing the respective processes of a method for manufacturing a magnetic device according to the present invention.

DETAILED DESCRIPTION OF THE INVENTION

Figure 1A:
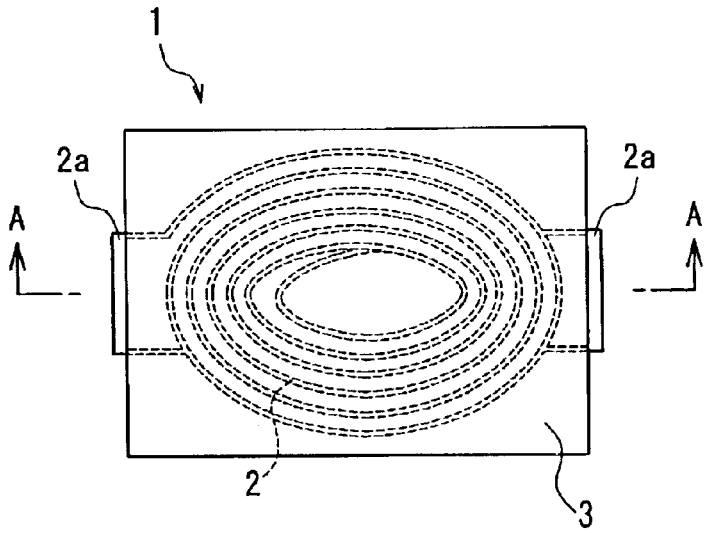
FIG. 1A is a plan view showing one embodiment of a sheet-type coil used in a magnetic device of the present invention.

A magnetic device of the present invention includes a sheet-type coil including a planar conductive coil and an insulating substance; and a first magnetic member in sheet form disposed on at least one of upper and lower surfaces of the sheet-type coil. In this magnetic device, the magnetic permeability of the insulating substance is smaller than the magnetic permeability of the first magnetic member. With this configuration, the magnetic flux traversing across the conductor constituting the planar conductive coil itself and their adjacent turns can be suppressed. Therefore, compared with a configuration where the planar conductive coil itself is embedded in a magnetics containing resin, an inductance value is increased, and a magnetic loss at high frequencies is decreased.

Preferably, the aforementioned magnetic device further includes a second magnetic member made of a magnetics containing resin and having a magnetic permeability larger than that of the insulating substance and smaller than that of the first magnetic member. Preferably, the second magnetic member is disposed at least in one position selected from a center portion and a peripheral portion of the sheet-type coil where a conductor constituting the planar conductive coil is not present. With this configuration, between the first magnetic members, the magnetic flux mainly passes through the second magnetic member provided at the center portion or the peripheral portion of the sheet-type coil, where the conductor is not present. Therefore, a higher inductance value can be obtained.

In the aforementioned magnetic device, preferably, the first magnetic member includes at least one selected from a ferrite sintered element, a dust core, a metallic magnetic element with a thickness of 30 $\mu$m or less, and a lamination including a metallic magnetic element with a thickness of 30 $\mu$m or less and an insulating layer.

In the aforementioned magnetic device, preferably, a protrusion is provided at a position of the first magnetic member, corresponding to a center portion or a peripheral portion of the sheet-type coil. This is for allowing the magnetic flux to pass through mainly the center portion and the peripheral portion of the sheet-type coil between the first magnetic members, where the conductor is not present, and for obtaining a high inductance value.

In the aforementioned magnetic device, preferably, the first magnetic member includes a metallic magnetic element with a thickness of 30 μm or less or a lamination including a metallic magnetic element with a thickness of 30 μm or less and an insulating layer, and a slit is provided at least in one position of the metallic magnetic element and in a direction intersecting a winding direction of a conductor constituting the planar conductive coil. In the case of a configuration with a second magnetic member, preferably, the slit is provided in a portion of the metallic magnetic element on and under which the second magnetic member is not provided. Further, preferably, a third magnetic member having an insulating capability is disposed in at least one portion of the slit. This third magnetic member may be made of the same material as the second magnetic member. This is for suppressing the leakage of the magnetic flux, and the same time for suppressing the eddy current loss.

In order not to impair the ease of handling, preferably, the slit is provided so as not to divide the metallic magnetic element completely into two or more pieces.

In the case where the first magnetic member is a lamination of metallic magnetic elements, preferably, the provided slits are located so as not to overlap among all of the layers of the metallic magnetic elements. In the case where the first magnetic member is a lamination of metallic magnetic elements, preferably, a total length of slits in one metallic magnetic element layer increases with increasing proximity of the metallic magnetic element layer to the sheet-type coil. This configuration is for suppressing the leakage of the magnetic flux, and at the same time for suppressing the eddy current loss effectively. Note here that, in the case of this configuration, the lamination may include a metallic magnetic element not provided with slits. For instance, in the case of the lamination including two metallic magnetic elements, only the metallic magnetic element arranged close to the sheet-type coil may be provided with slits and the metallic magnetic element arranged away from the sheet-type coil may not be provided with slits.

In the case where the first magnetic member is a lamination of metallic magnetic elements, preferably, the metallic magnetic element is an amorphous thin element. Preferably, the amorphous thin element is subjected to heat treatment at a temperature ranging from 300° C. to a crystallization temperature, inclusive. This configuration is for obtaining a favorable property.

In the aforementioned magnetic device, the magnetic powder is a metallic magnetic powder. Since the metallic magnetic powder has a large saturation magnetic flux density, a favorable DC superimposition property can be obtained.

In the aforementioned magnetic device, preferably, the planar conductive coil is configured with a double-stacked coil in which upper and lower coils wound in planar form are connected with each other at their inner most turns. This configuration increases a space factor of the planar conductive coil, and enables the terminal portion to be taken out without forming a hole in the first magnetic member, because the end of the conductive coil falls at the outer most turn of the coil.

In the aforementioned magnetic device, the outer shape of the planar conductive coil may be one of circular, elliptical and oval.

In the aforementioned magnetic device, the sheet-type coil may be provided as a part of a wiring layer of a wiring board and inside of or on a surface of the wiring board.

The aforementioned magnetic device further may include an adhesive layer provided between the first magnetic member and the sheet-type coil. This adhesive layer functions to bond the first magnetic member and the sheet-type coil.

A method for manufacturing a magnetic device of the present invention includes the steps of: (a) preparing a sheet-type coil including a planar conductive coil and an insulating substance; and (b) disposing a first magnetic member in sheet form having a magnetic permeability larger than that of the insulating substance on at least one of upper and lower surfaces of the sheet-type coil.

In the aforementioned manufacturing method, preferably, in the step (a) a large-sized sheet with a plurality of sheet-type coils provided thereon is prepared, and in the step (b) the first magnetic member is disposed on at least one of upper and lower surfaces of the individual sheet-type coils. After these steps, preferably, the step of: (c) cutting the large-sized sheet so as to form an individual magnetic device is carried out. With this method, a plurality of magnetic devices can be manufactured at one time.

In order to manufacture a magnetic device including the second magnetic member, in the step (a) a hole may be formed at a predetermined area of the sheet-type coil so as to penetrate the upper and lower surfaces of the sheet-type coil. The predetermined area is at least one position selected from a center portion and a peripheral portion of the sheet-type coil where a conductor constituting the planar conductive coil is not present. In the step (b) a second magnetic member in an uncured state may be disposed in the hole formed in the sheet-type coil, the second magnetic member being made by mixing a magnetic powder and an uncured resin, and the sheet-type coil and the first magnetic member may be integrated with each other by curing the second magnetic member. In addition, in the step (b) the first magnetic member may be disposed beforehand on at least one of the upper and lower surfaces of the sheet-type coil, the second magnetic member in an uncured state may be disposed in the hole formed in the sheet-type coil, another first magnetic member may be disposed on the other surface between the upper and lower surfaces of the sheet-type coil, and then the sheet-type coil and the first magnetic members may be integrated with each other by curing the second magnetic member.

A power supply module according to the present invention includes a wiring board and the magnetic device connected electrically with the wiring board. As stated above, the magnetic device according to the present invention is a thin magnetic device having a high inductance value, a low coil DC resistance, and a favorable DC superimposition property. Therefore, the power supply module manufactured by mounting the magnetic device together with other components such as the wiring board, a semiconductor chip, and a capacitor also has superior properties and can realize a thin configuration.

The following describes embodiments of the present invention. Although the following description deals with examples of a magnetic device used as an inductor, a choke coil, or the like, the magnetic device according to the present invention is not limited to these examples. Even when used as a transformer that requires a secondary winding, its effect can be obtained.

Embodiment 1

The following describes embodiments of a magnetic device according to the present invention, with reference to FIGS. 1 to 14.

Figure 1B:
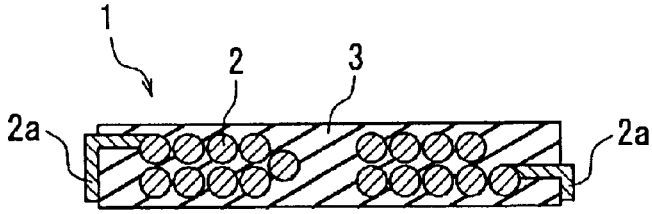
FIG. 1B is a cross-sectional view taken along line A—A of FIG. 1A.

FIG. 1A is a plan view showing one example of a sheet-type coil used in a magnetic device of the present invention, and FIG. 1B is a cross-sectional view taken along line A—A of FIG. 1A. A sheet-type coil 1 shown in FIGS. 1A and 1B has a configuration where a conductive coil 2 itself is embedded in an insulating substance, which is hardened in a planar form. Portions between adjacent turns that constitute the conductive coil 2 and around the conductive coil 2 make up an insulating portion 3 made of an insulating substance. The conductive coil 2 is a planar coil and more specifically is a double-stacked planar spiral coil where upper and lower two-layered coils are each wound in planar spiral form and the upper and lower coils are connected with each other at their inner most turns. The outer most turns of the upper and lower coils are both shaped like a flat plate and are taken out of the insulating resin so as to form terminal portions 2*a*. Note here that although in this embodiment terminal portions 2*a* of the sheet-type coil 1 are taken out in different directions from each other, a configuration for taking them out in the same direction also is acceptable.

Figure 2A:
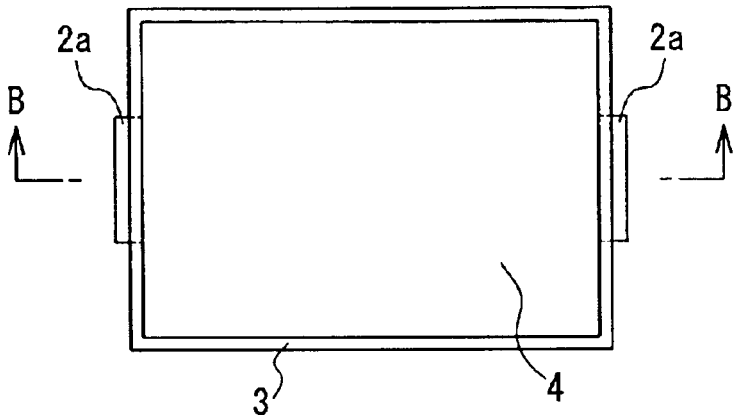
FIG. 2A is a plan view showing one embodiment of a magnetic device according to the present invention.
Figure 2B:
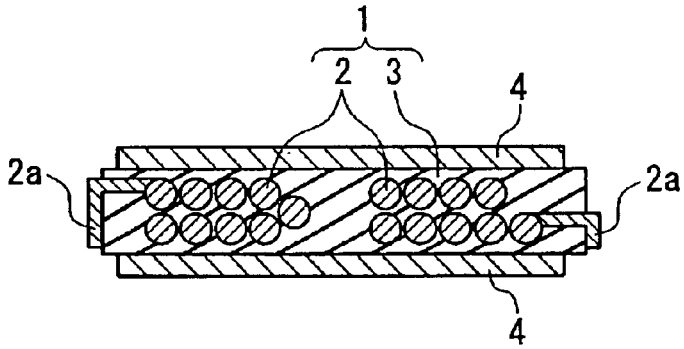
FIG. 2B is a cross-sectional view taken along line B—B of FIG. 2A.

FIG. 2A is a plan view showing one embodiment of a magnetic device according to the present invention, which uses the sheet-type coil 1, and FIG. 2B is a cross-sectional view taken along line B—B of FIG. 2A. In this magnetic device, first magnetic members 4 are disposed on upper and lower surfaces of the sheet-type coil 1, where the first magnetic members 4 and the sheet-type coil 1 directly contact with each other.

Figure 3A:
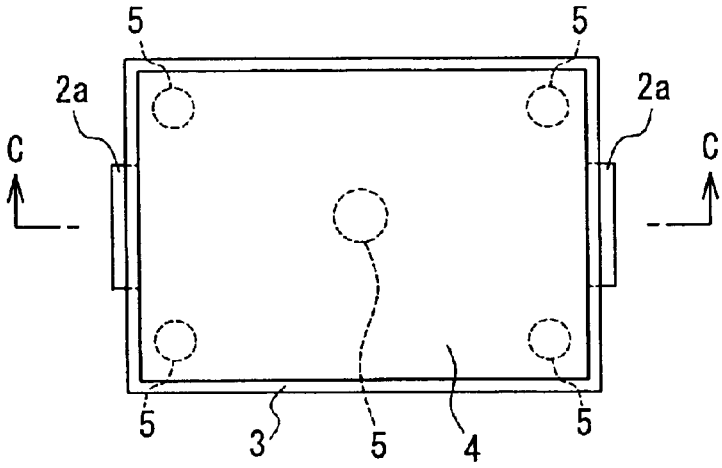
FIG. 3A is a plan view showing another embodiment of a magnetic device according to the present invention.
Figure 3B:
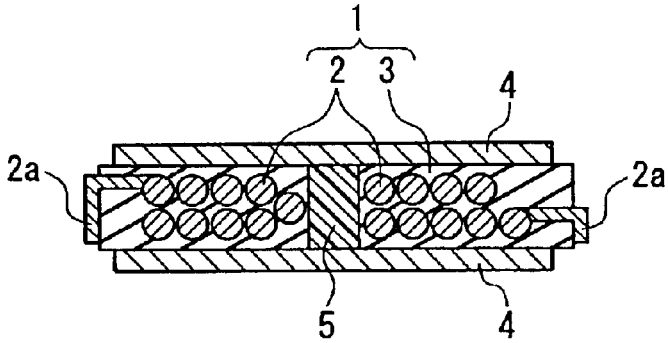
FIG. 3B is a cross-sectional view taken along line C—C of FIG. 3A.

FIG. 3A is a plan view showing another embodiment of a magnetic device according to the present invention, which uses the sheet-type coil 1, and FIG. 3B is a cross-sectional view taken along line C—C of FIG. 3A. In this magnetic device, the first magnetic members 4 are disposed on the upper and lower surface of the sheet-type coil 1, and second magnetic members 5 are provided at a center portion and four peripheral portions of the sheet-type coil 1, where the conductive coil 2 is not present. This second magnetic member 5 is made of a magnetics containing resin and has a magnetic permeability larger than that of the insulating substance used in the insulating portion 3 and smaller than that of the first magnetic member 4. The second magnetic members 5 have an adhesiveness, which bonds the first magnetic members 4 to the sheet-type coil 1. While the magnetic device shown in FIGS. 2A and 2B has an open magnetic path structure, the magnetic device shown in FIGS. 3A and 3B has a closed magnetic path structure because of the presence of the second magnetic members 5. With this configuration, the inductance value of the latter device is increased. However, if an area of the second magnetic members 5 becomes too large, then a DC superimposition property would deteriorate and a loss would be increased. Therefore, it is preferable to determine the number and the area of the second magnetic members, depending on the intended application.

The above-described two configurations are the basic configurations of a magnetic device according to the present invention, and the following configurations shown in FIGS. 4A and 4B through FIGS. 14A and 14B are each improved from these basic configurations having their respective objectives.

Figure 4A:
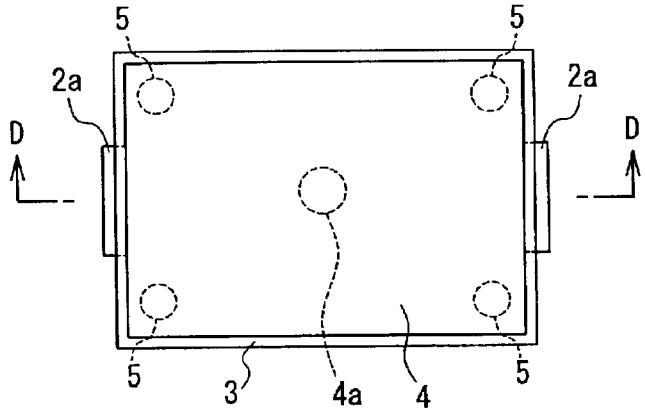
FIG. 4A is a plan view showing still another embodiment of a magnetic device according to the present invention.
Figure 4B:
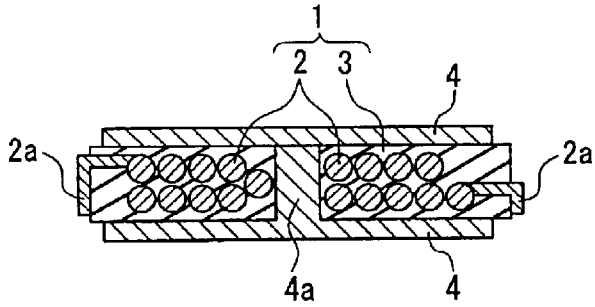
FIG. 4B is a cross-sectional view taken along line D—D of FIG. 4A.

FIG. 4A is a plan view showing still another embodiment of a magnetic device according to the present invention, which uses the sheet-type coil 1, and FIG. 4B is a cross-sectional view taken along line D—D of FIG. 4A. This magnetic device has a protrusion portion 4*a* provided at a center portion of one of the first magnetic members 4, where the protrusion portion 4*a* fits with a center portion of the sheet-type coil 1. At four peripheral portions of the sheet-type coil 1, the second magnetic members 5 are disposed. Although in the magnetic device according to this embodiment, the protrusion portion 4*a* provided on the lower first magnetic member 4 directly contacts with the upper first magnetic member 4, there may be a gap in some degree between the protrusion portion 4*a* and the opposite first magnetic member 4. In the case of the presence of the gap, such a gap may be an air gap or may be filled with the second magnetic member 5. The magnetic permeability of the first magnetic member 4 is larger than that of the second magnetic member 5, and therefore by providing the protrusion portion 4*a* on the first magnetic member 4 instead of the second magnetic member 5, the magnetic permeability can be increased and a larger inductance value can be obtained. However, this results in the degradation of the DC superimposition property. Therefore, the presence or absence of the protrusion portion 4*a*, the gap, and the second magnetic member 5 should be selected depending on the intended application. It should be noted that the provision of the protrusion portion 4*a* is necessarily followed by the process for fitting the protrusion portion 4*a* into a hole provided in the sheet-type coil 1, which degrades the productivity. Therefore, in consideration of this matter, the presence or absence of the protrusion portion 4*a* should be determined.

As the first magnetic member 4 in the above-described magnetic devices, a ferrite sintered element, a dust core, a thin metallic magnetic element with a thickness of 30 $\mu$m or less, or a lamination of the thin metallic magnetic element with a thickness of 30 $\mu$m or less and an insulating layer is available. However, in the case of providing the protrusion portion 4*a* on the first magnetic member 4, the ferrite sintered element and the dust core are used preferably, because these materials facilitate the formation of the protrusion portion. The following describes preferred configurations of magnetic devices when the first magnetic member 4 is made of the thin metallic magnetic element, with reference to FIGS. 5A and 5B to FIGS. 12A and 12B.

Figure 5A:
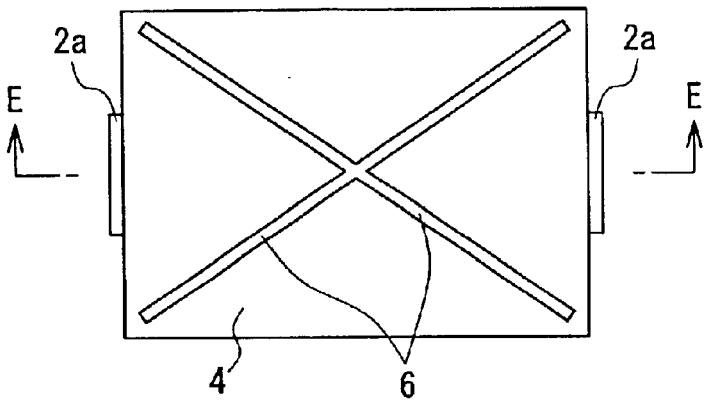
FIG. 5A is a plan view showing a further embodiment of a magnetic device according to the present invention.
Figure 5B:
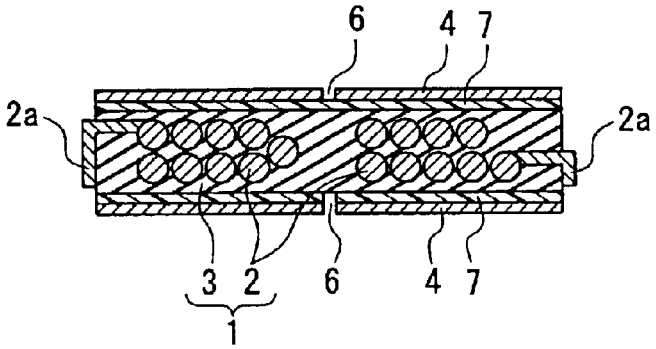
FIG. 5B is a cross-sectional view taken along line E—E of FIG. 5A.

FIG. 5A is a plan view showing a further embodiment of a magnetic device according to the present invention, which uses the sheet-type coil 1, and FIG. 5B is a cross-sectional view taken along line E—E of FIG. 5A. This magnetic device includes the first magnetic members 4 made of the thin metallic magnetic elements disposed on the upper and lower surfaces of the sheet-type coil 1 with an adhesive layer 7 intervening therebetween. The upper and lower first magnetic members 4 each include two slits 6 passing over the center of the conductive coil 2 and intersecting with each other. These slits 6 divide each of the first magnetic members 4 into four regions. The reason for providing these slits 6 is for reducing the eddy current loss, which becomes a problem when the thin metallic magnetic element is used as the first magnetic member 4. The slits 6 terminate at a portion in proximity to the edge of the first magnetic member 4 so as not to divide the first magnetic member 4 into four regions completely. This is because if the first magnetic member 4 is divided completely, then the handling thereof becomes difficult. Even when the first magnetic member 4 divided into the four regions includes portions slightly coupled to each other at an outer region where a magnetic flux density is not so high, the eddy current loss does not become so large. Therefore, such a configuration of the slits is preferable. The adhesive layer 7 is used for bonding the first magnetic members 4 and the sheet-type coil 1 together. The first magnetic members 4 can be provided directly on the surfaces of the sheet-type coil 1 by sputtering, plating, or the like, without such an adhesive layer 7, which results in the configuration of the magnetic device shown in FIGS. 2A and 2B. However, the direct formation of the first magnetic members 4 often leads to insufficient magnetic properties, and a vacuum process such as sputtering increases the manufacturing cost. Therefore, preferably, the first magnetic members 4 are manufactured beforehand separately. Thus, when using the thus separately manufactured first magnetic members 4, it is preferable to bond the first magnetic members 4 and the sheet-type coil 1 together with the adhesive layer 7.

Figure 6A:
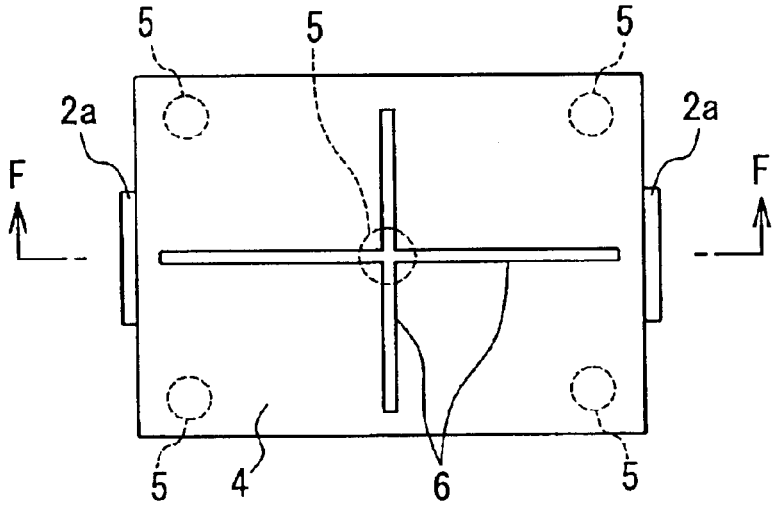
FIG. 6A is a plan view showing a still further embodiment of a magnetic device according to the present invention.
Figure 6B:
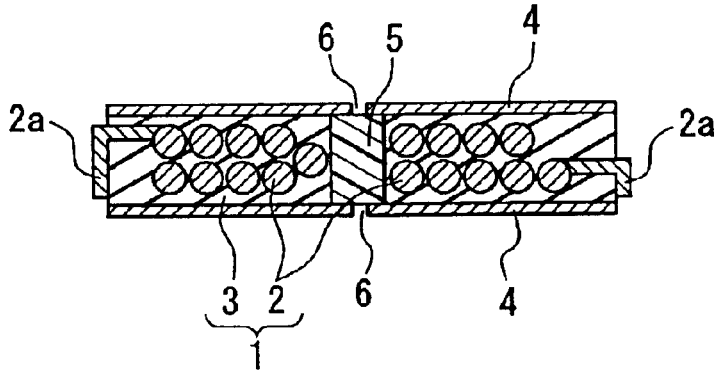
FIG. 6B is a cross-sectional view taken along line F—F of FIG. 6A.

FIG. 6A is a plan view showing a still further embodiment of a magnetic device according to the present invention, which uses the sheet-type coil 1, and FIG. 6B is a cross-sectional view taken along line F—F of FIG. 6A. In the same manner as in the magnetic device shown in FIGS. 5A and 5B, the first magnetic members 4 made of the thin metallic magnetic elements, each of which includes the slits 6 formed therein, are disposed on the upper and lower surfaces of the sheet-type coil 1. However, the adhesive layer is not used in this embodiment. Instead, the second magnetic members 5 are disposed at a center portion and four peripheral portions of the sheet-type coil 1. Since this second magnetic member 5 is made of a magnetic containing resin, the adhesiveness of the resin components bonds the first magnetic member 4 to the sheet-type coil 1 so as to be integrated with each other. The slits 6 pass over the center of the conductive coil 2 and form a shape like a cross with respect to the rectangular first magnetic member 4. It should be noted that the slits arranged along the diagonal lines of the first magnetic member 4 as shown in FIG. 5A have greater effects for reducing the eddy current loss, compared with the slits formed in the shape of a cross as in this embodiment, and therefore the former is preferable to the latter.

Figure 7A:
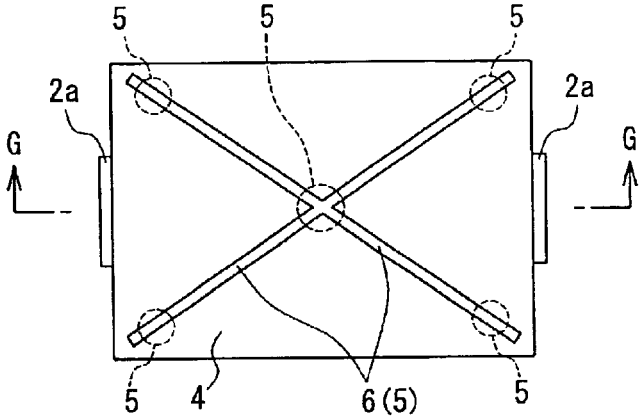
FIG. 7A is a plan view showing another embodiment of a magnetic device according to the present invention.
Figure 7B:
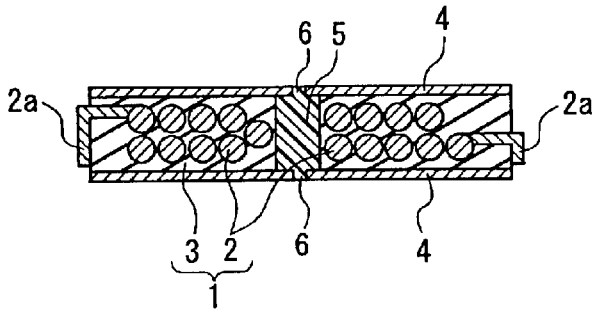
FIG. 7B is a cross-sectional view taken along line G—G of FIG. 7A.

FIG. 7A is a plan view showing another embodiment of a magnetic device according to the present invention, which uses the sheet-type coil 1, and FIG. 7B is a cross-sectional view taken along line G—G of FIG. 7A. The magnetic device shown in FIGS. 7A and 7B has a configuration similar to the magnetic device shown in FIGS. 6A and 6B, but the second magnetic member 5 is arranged in the slits 6 provided in the first magnetic member 4. If no magnetic element is present in the slits 6, the magnetic flux is likely to leak. However, the leakage flux can be decreased by arranging the second magnetic member 5 in that portion, and the eddy current loss is hardly increased. It should be noted that the second magnetic member 5 is not necessarily arranged all over the slits 6 but may be arranged at least at one portion thereof Preferably, the second magnetic member 5 is arranged in the slits that are arranged at a center portion of the coil where the magnetic flux density is high. In addition, although in this embodiment the second magnetic member 5 is used as a magnetic member arranged in the slits 6, a magnetic member (a third magnetic member) made of a material different from that of the second magnetic member 5 can be used insofar as the magnetic members have an insulating capability.

Figure 8A:
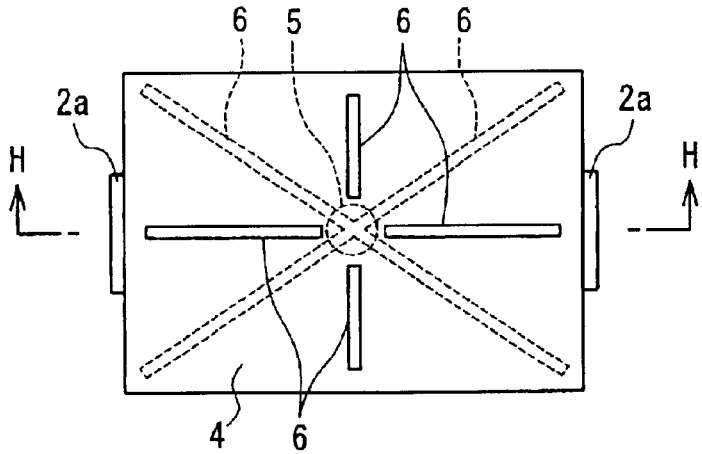
FIG. 8A is a plan view showing a still another embodiment of a magnetic device according to the present invention.
Figure 8B:
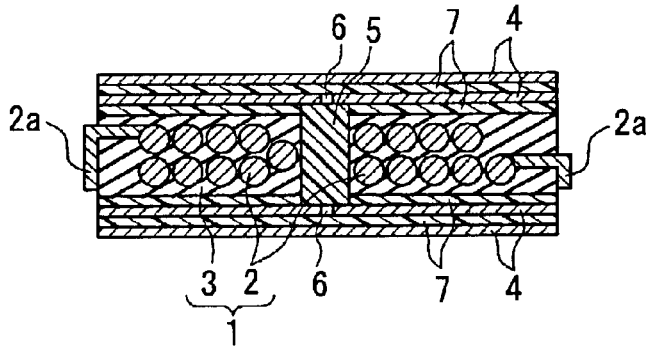
FIG. 8B is a cross-sectional view taken along line H—H of FIG. 8A.

FIG. 8A is a plan view showing a still another embodiment of a magnetic device according to the present invention, which uses the sheet-type coil 1, and FIG. 8B is a cross-sectional view taken along line H—H of FIG. 8A. This magnetic device includes a lamination of two layers made of thin metallic magnetic elements with an insulating layer intervening therebetween. In this embodiment, the adhesive layer 7 is used as the insulating layer arranged between the two thin metallic magnetic elements. Note here that the insulating layer mentioned in the present invention is not necessarily a specific substance present therein, because the insulating layer aims to prevent the eddy current from flowing across two or more laminated layers of the thin metallic magnetic elements. That is to say, even with the configuration including a lamination of a plurality of layers of thin metallic magnetic elements, contact resistance in some degree would be generated among these layers, unless these layers are integrated completely. Hence, compared with a single layer of thin metallic magnetic element having a thickness corresponding to the total thickness of these layers, the eddy current loss would be decreased. However, in the case of this configuration where a specific insulating substance is not used, an electrical contact state among the thin metallic magnetic elements would change by a pressure applied in the vertical direction to the device, so that the property of the device would fluctuate. In addition, because of the absence of the adhesiveness between the thin metallic magnetics elements, the problem such as low reliability tends to occur. Therefore, it is preferable that the adhesive layer having an insulating capability is present between the thin metallic magnetic elements as shown in FIG. 8B. Between the two thin metallic magnetic elements shown in FIG. 8B, one thin metallic magnetic element arranged at the proximal side of the sheet-type coil 1 (i.e., the inner thin metallic magnetic element) is provided with slits having the same geometry as the slits 6 shown in FIG. 5A. The other thin metallic magnetic element arranged at the distal side of the sheet-type coil 1 (i.e., the outer thin metallic magnetic element) is provided with slits 6 at positions not coinciding with the slits 6 in the inner thin metallic magnetic element and not at the center portion of the conductive coil 2. The two thin metallic magnetic elements are integrated with the insulating adhesive layer 7 provided therebetween. Since the second magnetic member 5 is provided only at a central portion of the sheet-type coil 1, the adhesive layer 7 doubles as the adhesive for bonding the first magnetic member 4 and the sheet-type coil 1. In this way, the first magnetic member 4 is made up of the two thin metallic magnetic elements, which results in the decrease of the magnetic flux density. As a result, the inductance value is improved, the magnetic loss is decreased, and the DC superimposition property is improved. In addition, the leakage flux also can be decreased by displacing the slits provided in the upper and lower two thin metallic magnetic elements.

Figure 9A:
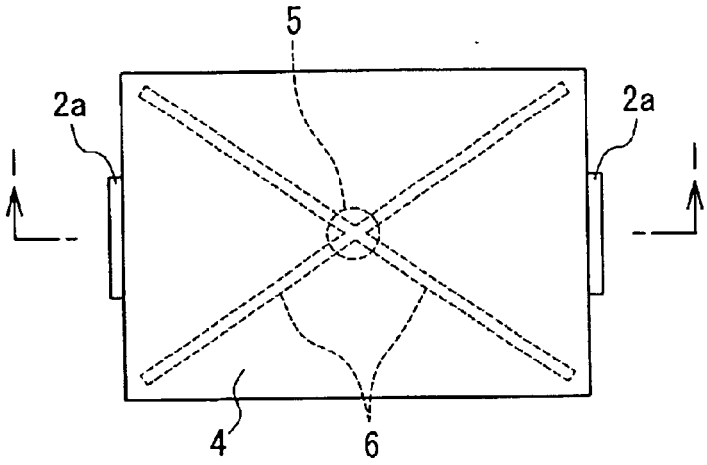
FIG. 9A is a plan view showing a further embodiment of a magnetic device according to the present invention.
Figure 9B:
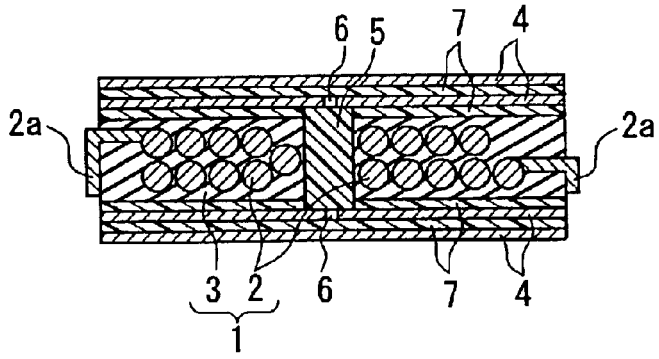
FIG. 9B is a cross-sectional view taken along line I—I of FIG. 9A.

FIG. 9A is a plan view showing a further embodiment of a magnetic device according to the present invention, which uses the sheet-type coil 1, and FIG. 9B is a cross-sectional view taken along line I—I of FIG. 9A. This magnetic device has a configuration including the first magnetic member 4 configured as the lamination in the same manner as in the magnetic device shown in FIGS. 8A and 8B. However, the outer thin metallic magnetic element is not provided with slits, whereas the inner thin metallic magnetic layer is provided with slits 6 as in the magnetic device shown in FIGS. 8A and 8B. The reason for this configuration is as follows: that is, when the first magnetic member 4 is made up of a lamination including two thin metallic magnetic elements, the magnetic flux tends to concentrate on the inner thin metallic magnetic element, which is closer to the coil, and therefore the magnetic loss does not increase considerably even in the absence of slits in the outer thin metallic magnetic element.

Figure 10A:
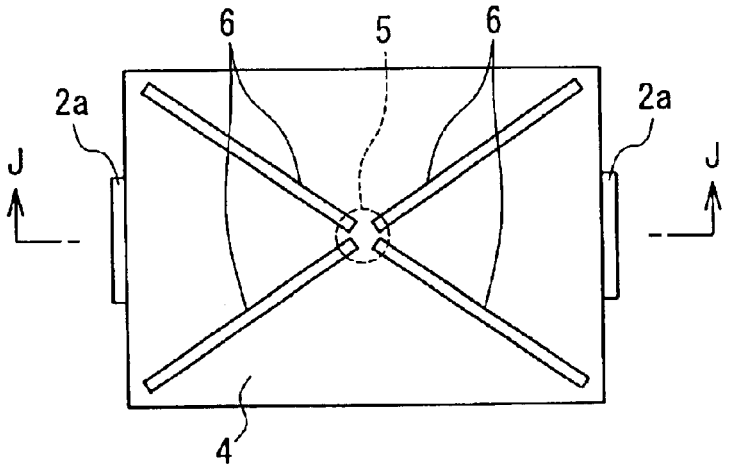
FIG. 10A is a plan view showing a still further embodiment of a magnetic device according to the present invention.
Figure 10B:
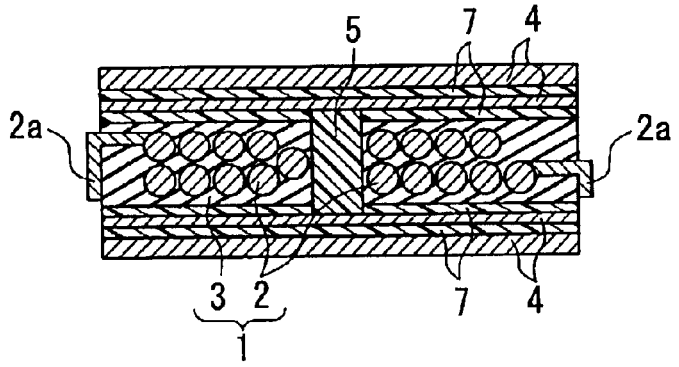
FIG. 10B is a cross-sectional view taken along line J—J of FIG. 10A.

FIG. 10A is a plan view showing a still further embodiment of a magnetic device according to the present invention, which uses the sheet-type coil 1, and FIG. 10B is a cross-sectional view taken along line J—J of FIG. 10A. This magnetic device has a configuration including the first magnetic member 4 configured as the lamination in the same manner as in the magnetic device shown in FIGS. 8A and 8B. However, the outer thin metallic magnetic element is formed thicker than the inner thin metallic magnetic element. This configuration is for improving the DC superimposition property without increasing the magnetic loss by making the inner thin metallic magnetic element, on which the magnetic flux concentrates, thin and the outer thin metallic magnetic element thick.

Figure 11A:
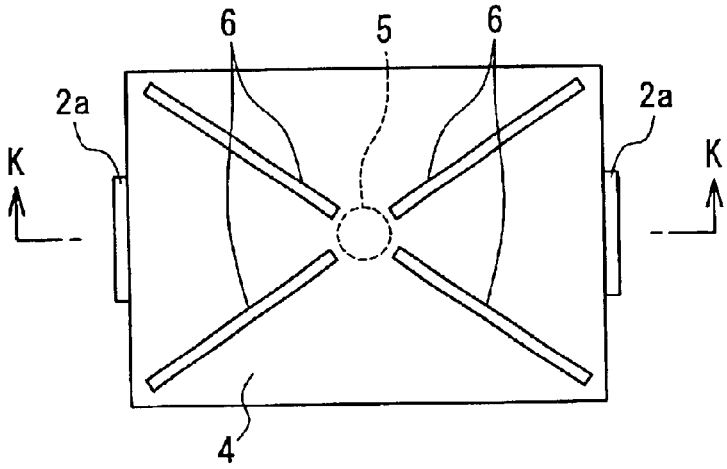
FIG. 11A is a plan view showing another embodiment of a magnetic device according to the present invention.
Figure 11B:
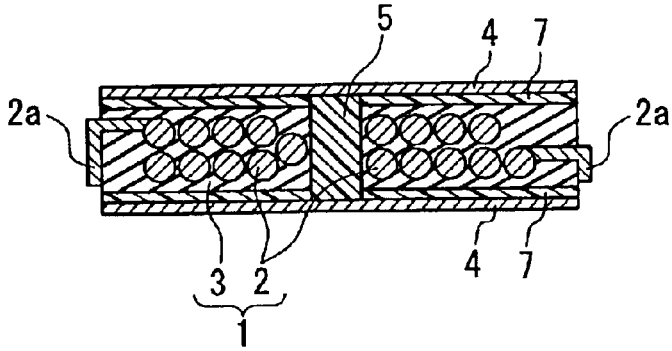
FIG. 11B is a cross-sectional view taken along line K—K of FIG. 11A.

FIG. 11A is a plan view showing another embodiment of a magnetic device according to the present invention, which uses the sheet-type coil 1, and FIG. 11B is a cross-sectional view taken along line K—K of FIG. 11A. Although this magnetic device has a configuration similar to that of the magnetic device shown in FIGS. 7A and 7B, the slits 6 are not formed at a position located immediately above and below the second magnetic member 5 in the upper and lower first magnetic members 4. This configuration is for preventing the leakage of the second magnetic member 5 from the slits 6. Although this configuration aims to solve the problem concerning the manufacturability, the properties of the inductance value and the DC superimposition property are improved but the magnetic loss is increased slightly.

Figure 12A:
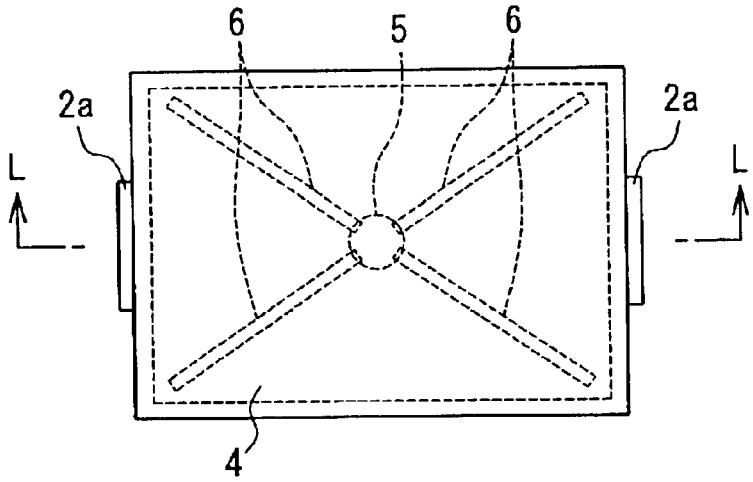
FIG. 12A is a plan view showing still another embodiment of a magnetic device according to the present invention.
Figure 12B:
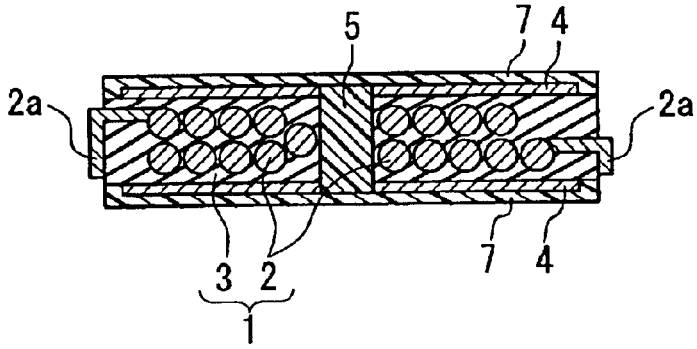
FIG. 12B is a cross-sectional view taken along line L—L of FIG. 12A.

FIG. 12A is a plan view showing still another embodiment of a magnetic device according to the present invention, which uses the sheet-type coil 1, and FIG. 12B is a cross-sectional view taken along line L—L of FIG. 12A. Although this magnetic device has a configuration similar to that of the magnetic device shown in FIGS. 7A and 7B, outer surfaces of the upper and lower first magnetic members 4 are covered with the adhesive layers 7. This also is one method for bonding the first magnetic members 4 and the sheet-type coil 1. In addition, in the case of the first magnetic member 4 made of thin metallic magnetic element, an outer surface of the magnetic device is made of metallic magnetics with low electrical resistance. Then, by employing the configuration shown in FIG. 12A, an insulation capability can be given to the outer surface. Such a configuration where the outer surface of the first magnetic member 4 is covered with the adhesive layer 7 is effective also for the case where the first magnetic member 4 is made of a dust core, MnZn ferrite, which has slightly lower electrical resistance among ferrite sintered elements, or the like. Note here that when using this method of covering the outer surface of the magnetic element with the adhesive layer, a plurality of layers of thin metallic magnetic elements can be fixed without a specific insulating substance and an adhesive layer provided between the layers by making an area of an outer elements smaller than that of an inner layer and covering such layers with an adhesive layer. However, in this case also, the problem as stated with reference to FIG. 8 would remain, in that an electrical contact state among the thin metallic magnetic elements would change by a pressure applied in the vertical direction to the device, which results in a fluctuation in the property of the device.

Figure 13A:
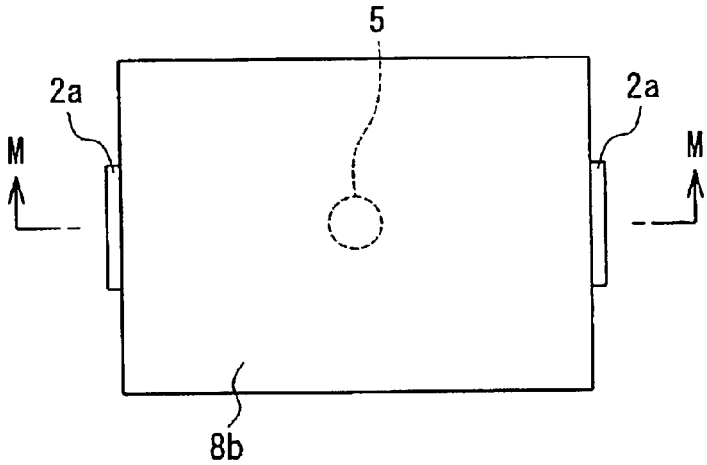
FIG. 13A is a plan view showing a further embodiment of a magnetic device according to the present invention.
Figure 13B:
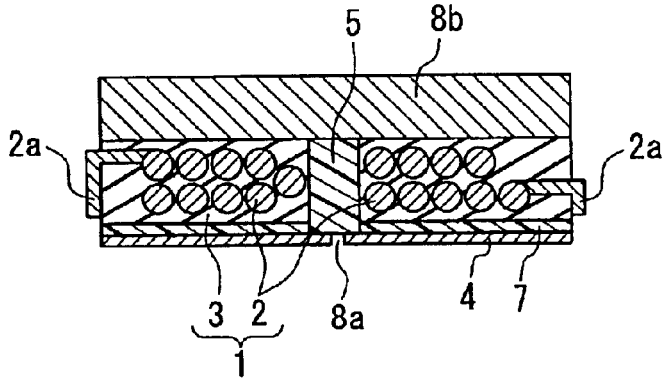
FIG. 13B is a cross-sectional view taken along line M—M of FIG. 13A.

Next, FIGS. 13A and 13B show the case where the upper and lower first magnetic members 4 are made of different materials. Although this magnetic device has a configuration similar to that of the magnetic device shown in FIGS. 6A and 6B, thin metallic magnetic element 8*a* is provided on one surface of the sheet-type coil 1, and a board 8*b* made of a ferrite sintered element is provided on the other surface. The main reason for using the thin metallic magnetic element is that the magnetic device can be made thinner, but in this case the magnetic loss becomes larger than the device using a ferrite sintered element. Therefore, according to this configuration, a favorable property can be obtained without increasing the thickness of the device considerably.

Figure 14A:
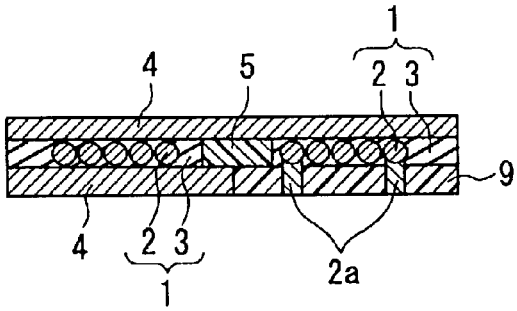
FIG. 14A is a cross-sectional view showing a still further embodiment of a magnetic device according to the present invention.
Figure 14B:
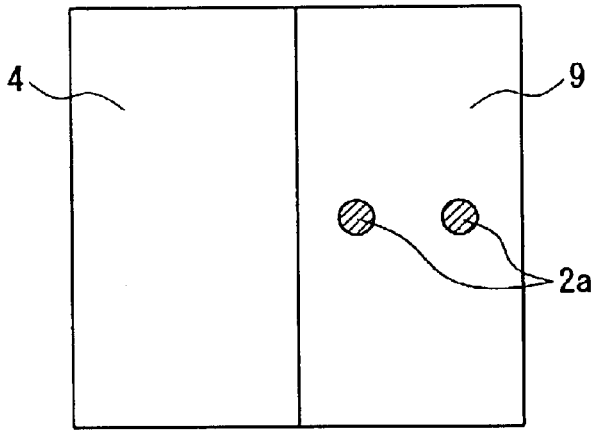
FIG. 14B is a plan view of the magnetic device from the lower first magnetic member side.

Next, a further configuration example is described, with reference to FIGS. 14A and 14B. FIG. 14A is a cross-sectional view showing a further embodiment of a magnetic device according to the present invention, and FIG. 14B is a plan view of the magnetic device shown in FIG. 14A from the lower first magnetic member side. This magnetic device employs a single-layer conductive coil 2, which is different from the sheet-type coil 1 shown in FIGS. 1A and 1B. In addition, the terminal portions 2*a* are taken out from the lower surface of the device. In this way, naturally, the conductive coil 2 can be configured with a coil not having a double-stacked structure. In this case, the number of turns of the coil is decreased, but the coil easily is made to be thinner. However, while one of the terminal portions 2*a* is located at an outer portion of the coil, the other portion is located at an inner portion thereof. Therefore, as for the latter portion, the terminal has to be taken out by, for example, boring a hole in the first magnetic member 4. Then, in order to facilitate taking the terminal out, a magnetics containing resin portion 9, which is formed with a magnetics containing resin including a mixture of a magnetic power and a resin, is provided at a portion of the lower first magnetic member 4.

The above description indicates some embodiments of a magnetic device according to the present invention, and the present invention is not limited to these embodiments. Although these embodiments are described as to an inductance device of 2 to 20 mm square in size and approximately 0.1 to 2 mm in thickness and in ultra-thin rectangular board form, other forms also are acceptable.

In addition, the slits 6 provided in the case where the first magnetic members 4 are made of thin metallic magnetic elements aim to cut off an eddy current flowing through the thin magnetic element. Therefore, the slits 6 in any number can be formed in the direction traversing the conductive coil 2 (preferably, in the direction intersecting with the conductive coil 2 at right angles) and with a very small width, specifically, several $\mu$m to 100 $\mu$m. If the width exceeds this range, then the leakage flux would increase. As for the number of slits, the slits may constitute two intersecting lines, only one line, or three or more lines extending radially. Although the effect of the abatement in the eddy current loss increases with increasing the number of slits, the rate of such improvement decreases, an inductance value obtained decreases gradually, and the leakage flux increases. Therefore, in view of the required properties, the cost and the like, an appropriate slit pattern should be selected. Further, as stated above, preferably the slits 6 are not formed from one edge to the opposite edge of the first magnetic member 4 so as not to divide the first magnetic member 4 completely. This is because, although a slit formed from one edge to the opposite edge produces a large effect of the abatement in the eddy current loss, most of the eddy currents, which might occur in the absence of the slits 6, can be cut off even in the case where end portions of the first magnetic member 4 are coupled with each other or the slits are not formed around a center portion of the first magnetic member 4, and therefore such a slit can produce the apparent effect. Also, when manufacturing a magnetic device in reality, the metallic magnetic element in thin plate form that is divided into a plurality of pieces is difficult to be handled, and therefore it is preferable that such an element is not divided completely. As a result of the examinations by the inventors, in view of the eddy current loss and the other advantages and disadvantages, the most preferable pattern is that the slits 6 are formed diagonally at least like a cross mark "x", formed radially like an asterisk mark "*" and not formed at the outer most portion where the magnet flux does not concentrate, or not formed at the outer most portion and at a center portion.

Although this embodiment deals with the case where the lamination of thin metallic magnetic elements as the first magnetic member 4 includes two thin metallic magnetic elements, the lamination may include three or more thin metallic magnetic elements. Note here that although the properties are improved with increasing the number of layers, the thickness of the device also becomes large, and the rate of such improvement decreases with increasing number of layers. Therefore, the number of layers should be selected appropriately, depending on the intended application.

Also, in this embodiment, when the first magnetic member 4 includes the lamination of thin metallic magnetic elements, the slits provided in the two thin metallic magnetic elements are arranged so as not to overlap each other, in order to decrease the leakage flux. However, in the case of including three of more thin metallic magnetic elements, the location of the slits provided in two layers of such layers may overlap each other insofar as the slits in the remaining one layer do not overlap those in the two layers.

In the configuration of laminating a plurality of thin metallic magnetic elements, preferably, a total length of slits 6 is longer in the thin metallic magnetic element arranged closer to the sheet-type coil 1, while a total length of slits 6 is shorter in the thin metallic magnetic element arranged away from the sheet-type coil 1. This configuration is for suppressing the leakage of the magnetic flux. As one example of this configuration, the magnetic device shown in FIGS. 9A and 9B is configured so that slits 6 are not formed in the outer thin metallic magnetic element. Such a configuration for decreasing the total length of slits 6 provided in the outer thin metallic magnetic element can be realized by, for example, reducing the number of slits 6 or the area of the slits 6 provided in the metallic magnetic element arranged at an outer side.

As in the magnetic device shown in FIGS. 13A and 13B, only one of the upper and lower first magnetic members can be made of thin metallic magnetics. However, in order to make the device thinner, it is preferable that both of the upper and lower first magnetic members are made of thin metallic magnetics.

Furthermore, if the respective configurations where the first magnetic member 4 is made of thin metallic magnetics as stated above are embodied at the same time, then the effect obtained would become remarkable.

According to the magnetic device of the present invention, since the conductive coil 2 is embedded in the insulating substance having a permeability smaller than that of the first magnetic member 4 and the second magnetic member 5, the magnetic flux traversing inside of the conductor and adjacent turns is decreased. Therefore, compared with the conventional magnetic device where the conductive coil is embedded in a resin containing magnetics, the inductance value can be increased, and the magnetic loss at high frequencies can be decreased. Although the second magnetic member 5 may occupy all over the center portion of the sheet-type coil 1, it is not preferable that the member occupies all over the peripheral portion of the sheet-type coil 1. This is because, the latter case, that is, where a magnetic member is arranged all over the peripheral portion, hinders terminals from being taken out from the conductive coil 2. Therefore, when the second magnetic member 5 is provided also at a peripheral portion of the conductive coil 2, the shape of the sheet-type coil 1 may be made rectangular, and the shape of the conductive coil 2 may be made circular, elliptical, oval or the like, by which the second magnetic members 5 can be arranged at four corners of the sheet-type coil 1. Therefore, such shapes of the elements are effective.

As stated above, a magnetic device according to the present invention includes at least: (1) the sheet-type coil 1; and (2) the first magnetic member 4, and in some cases further includes: (3) the second magnetic member 5; and (4) the adhesive layer 7. The following sections (1) to (4) describe each configuration of these elements in detail.

(1) Sheet-type Coil 1

As the sheet-type coil 1, any sheet-type coil formed by embedding a planar coil as the conductive coil 2 in an insulating substance and hardening the insulating substance into sheet form. Here, usually the insulating substance used is an insulating resin such as a thermosetting resin and the planar coil includes a planar coil formed using a required turns of a round wire, a rectangular wire, a foil-shaped wire or the like, or a planar coil manufactured by plating, etching, and punching. However, in order to realize a low resistance value and a high inductance value, a space factor of the conductive coil 2 has to be increased, and therefore it is preferable that a ratio between the conductor width and the space between adjacent turns (i.e., conductor width/the space between adjacent turns) and a ratio between the conductor thickness and the space between adjacent turns (i.e., conductor thickness/the space between adjacent turns) are set at more than 3, and more preferably at more than 5. For that reason, a coil formed by etching and punching is not preferable, whereas a coil formed by winding a wire (winding method) or plating is preferable. In addition, naturally, it is preferable to make a coating of the conductive coil 2, which is made of an insulating substance, as thin as possible.

Preferably, the conductive coil 2 has a double stack structure, in each layer of which a conductor is wound in planar spiral form so as to make up a coil, and the upper and lower coils are connected with each other at their inner most turns. As for the method for connecting the upper and lower coils, in the case of manufacturing the coil using a winding method, the upper and lower coils are wound together so as to form such a structure, while in the case of manufacturing the coil by plating, a method such as a through hole plating method can be used. According to this configuration, a space factor can be increased, and the terminal portion 2*a* can be taken out easily without boring a hole in the upper and lower first magnetic members 4, because the end of the conductive coil falls at the outer most side of the coil. Note here that the conductive coil 2 preferably is made of a material of low resistance, and therefore, usually, copper is used preferably. Preferably, the outer shape of the conductive coil 2 is made circular, oval or elliptical, rather than rectangular as often is used as a planar spiral coil. This is because these shapes can reduce the resistance of the conductor in the most effective manner possible, when compared at the same number of turns, and at the same time, it becomes easy to secure a space for arranging the second magnetic members 5 around the conductive coil 2. Note here that the conductive coil 2 is not limited to a spiral coil, and other planar coils such as a meander coil also are available. In the case of employing the meander coil, the terminal can be taken out of the outer edge portion without the conductors intersecting with each other. Therefore, there is no need for employing the double-stacked coil. However, in terms of the properties, the spiral coil is superior to the meander coil. Particularly, in the case of the configuration including the second magnetic member, the spiral coil is more preferable.

The insulating substance is required to have a magnetic permeability smaller than that of the first magnetic member 4 and the second magnetic member 5. Therefore, preferably a non-magnetic substance or the like is used. Specific examples of the insulating substance include an epoxy resin, a silicon resin, a polyimide resin and the like.

Note here that after a step of forming the planar conductive coil 2, a center portion and a peripheral portion, in which the conductor is not present, might be filled with the insulating substance, and therefore there are no holes for arranging the second magnetic members 5. In this case, the insulating substance occupying the portions for arranging the second magnetic member 5 should be removed with means such as a drill, a laser, or a puncher.

(2) First Magnetic Member 4

A magnetic material used as the first magnetic member 4 is required to have a high magnetic permeability, a large saturation magnetic flux density and a superior high frequency property. Available materials include three materials: a ferrite sintered element, a dust core, and a thin metallic magnetic element. As the ferrite sintered element, MnZn ferrite, NiZn ferrite and the like are used. As the dust core, a substance obtained by binding a metallic magnetic powder made of Fe, a Fe—Si—Al base alloy, a Fe—Ni base alloy, or the like with a binder such as a silicone resin and a glass so as to be packed closely to a filling rate of about 90% is used. As the thin metallic magnetic element, a Fe—Si thin element, an amorphous thin element, a nanocrystal precipitation thin element or the like is used.

Among them, the ferrite sintered element and the dust core tend to become vulnerable to brittle fracture when processed into an ultra-thin and large-area member. However, these materials become resistant to the fracture by being integrated with the sheet-type coil 1. When the ferrite sintered element is used, a magnetic device with a small magnetic loss can be obtained, but there is a limitation on the thickness of the device. When the dust core is used, a magnetic device with a superior DC superimposition property can be obtained, but an inductance value obtained is not so large and there is a limitation on the thickness of the device in a like manner as in the ferrite sintered element. The thin metallic magnetic element is resistant to brittle fracture, and moreover has a saturation magnetic flux density larger than that of the ferrite sintered element, and therefore this material is advantageous in making it thinner. As for the composition, any composition is available insofar as Fe, Co, and Ni are contained as main components. Further, since a high magnetic permeability, a large saturation magnetic flux density and a superior high frequency property are required, an amorphous thin element manufactured by a super-rapid cooling method, a microcrystal precipitation thin element obtained by applying heat to the amorphous thin element or a thin metallic magnetic element manufactured by sputtering or plating can be listed. Among these materials, the microcrystal precipitation thin element has a problem of the mechanical strength, and the thin element formed by sputtering has a problem of the cost. Therefore, the thin metallic magnetic element manufactured by the super-rapid cooling method or plating is more preferable. Preferably, the thickness of these thin metallic magnetic elements is set at about 30 $\mu$m or less, in order to suppress the magnetic loss. When forming the amorphous thin element by the super-rapid cooling method, it is difficult to realize a thickness of a limited value or less. In such a case, the amorphous thin element is immersed in an aqueous solution including nitric acid and the like so as to be etched into a required thickness. As a result of the etching process, a thin metallic magnetic element with a desired thickness can be obtained, so that the eddy current loss at high frequencies can be reduced. At the same time, since an alternation layer located at the surface is removed, a magnetic permeability can be increased, and a large inductance value can be obtained. On the other hand, an excessively thin metallic magnetic element causes an unfavorable DC superimposition property. Therefore, in such a case, a plurality of thin metallic magnetic elements can be laminated via an insulating layer so as to make up a lamination, and the lamination can be used as the first magnetic member 4. In this lamination, it is preferable that the thickness of the insulating layer is made as thin as possible, and is formed at not more than approximately twice the thickness of the thin metallic magnetic element.

The shape of the first magnetic member 4 is not limited to a rectangle, and may be a circle, an ellipse, an oval, or the like insofar as the first magnetic member 4 covers the conductive coil 2. However, the rectangular first magnetic member 4 is preferable, because such shaped member facilitates the provision of the space for forming the second magnetic members 5 at four corners thereof when a circular, elliptical, or oval conductive coil is used.

As a method for forming the slits 6 in the thin metallic magnetic element, a plurality of thin metallic magnetic elements cut beforehand may be used. However, since this method impairs the each of handling, an etching process using a mask is preferable. When the thin metallic magnetic film is formed by sputtering and plating, the film should be formed using a mask so as to form slits at predetermined positions. Note here that, in the case where the slits 6 are formed in each of the upper and lower two thin metallic magnetic elements, there is no need to form the slits 6 of the same geometry in the upper and lower elements.

Further, the upper and lower first magnetic members 4 can be formed using different materials, for example, one made of a ferrite sintered element and the other made of an amorphous thin element. In addition, as shown in FIGS. 14A and 14B, a portion of the first magnetic member 4 can be formed using a magnetics containing resin. Note here that if all of the upper and lower first magnetic members 4 are formed using the magnetics containing resin, then the magnetic permeability of the first magnetic member 4 would be decreased, thus decreasing the inductance value considerably. Therefore, it is preferable to restrict an area occupied by the magnetics containing resin to about a half or less of the total area of the upper and lower first magnetic members 4. The types of a magnetic powder and a resin used as the magnetics containing resin are in conformity with these of the second magnetic member 5, which will be described in the following.

In the case where the first magnetic member 4 is made of an insulating substance such as NiZn ferrite, there is no need to cover the upper and lower surfaces of the conductive coil with an insulating substance, and the conductive coil in that portion may be exposed. In this case, preferably, an anticorrosives is applied on the upper and lower surfaces in order to enhance the environmental resistance of the conductive coil.

(3) Second Magnetic Member 5

The second magnetic member 5 at least includes a mixture of a magnetic powder and a resin. As the magnetic powder, a ferrite powder or a metallic magnetic powder containing Fe, Ni, or Co as a main component is available. More specifically, insofar as a powder exhibits a soft magnetic property, any powder such as a MnZn ferrite powder, a NiZn ferrite powder, a MgZn ferrite powder, a Fe powder, a Fe—Si base alloy powder, a Fe—Si—Al base alloy powder, a Fe—Ni base alloy powder, a Fe—Co base alloy powder, a Fe—Mo—Ni base alloy powder, a Fe—Cr—Si base alloy powder and a Fe—Si—B base alloy powder is available basically. However, if a ferrite base powder with a low saturation magnetic flux density is used, then the saturation magnetic flux density further is decreased because the powder is diluted with the resin, thus degrading the DC superimposition property. Therefore, it is preferable to use a metallic magnetic powder with a large saturation magnetic flux density. As for the particle diameter of the magnetic powder, 100 μm or less, more preferably 30 μm or less, is preferable. This is because, in the case of using the metallic magnetic powder, an excessively large particle diameter causes an increase in the eddy current loss at high frequencies. On the other hand, an excessively small particle diameter requires a large amount of organic resin, which results in a considerable decrease in the magnetic permeability of the second magnetic member 5. For that reason, as for the particle diameter of the magnetic powder, 0.5 μm or more, more preferably 2 μm or more, is preferable.

As for the resin, insofar as the resin exhibits a binding capability, any resin is available. However, in terms of the strength after binding and the heat-resisting property during operation, a thermosetting resin is preferable. In order to improve the dispersibility of the magnetics powder, a very small quantity of dispersing agent or the like may be added. Also, a small quantity of plasticizer or the like may be added as required. In addition, a third component may be added so as to adjust the properties of the paste before curing or improve the insulating property in the case of using the metallic magnetic powder. The third component includes a silane base coupling agent, a titanium base coupling agent, titanium alkoxide, soluble glass and the like, or powder made of boron nitride, talc, mica, barium sulfate, tetrafluoroethylene and the like.

Although in the above embodiment, the shape of the second magnetic member 5 is cylindrical, the shape is not limited to this. If a large area of the second magnetic member 5 is required, a suitable shape such as triangular prism may be formed at a peripheral portion of the conductive coil 2.

(4) Adhesive Layer 7

As for the adhesive layer 7, insofar as the adhesive layer exhibits a binding capability, any material is available. However, in terms of the strength after binding and the heat-resisting property during operation, a thermosetting resin such as an epoxy resin, a phenol resin, a silicone resin and a polyimide resin is preferable. Although the adhesive layer 7 with a small thickness is preferable, the formation of too thin layers involves some difficulties. Therefore, a layer with a thickness of several μm to 50 μm is appropriate normally. In addition, it is preferable to employ a sheet configured by applying an adhesive of about several to several tens of μm in thickness on either side of an insulating film of several μm in thickness, because this configuration can realize the insulation between the conductive coil 2 and the first magnetic member 4 or between the upper and lower first magnetic members 4 easily.

Embodiment 2

The following describes embodiments of a method for manufacturing a magnetic device according to the present invention.

According to the present invention, the manufacturability of the magnetic device can be enhanced dramatically by using a coil that has been molded in sheet form beforehand. Meanwhile, the magnetic device shown in FIGS. 4A and 4B, for example, can be formed by the following method without using such a coil molded beforehand. That is, a wire having a diameter of about one half of a space between the upper and lower first magnetic members 4 is prepared. This wire is wound around a center portion (the protrusion portion 4*a*) so as to make up a coil, the outside of the coil is filled with an uncured resin paste, and then the resin paste is cured. Thereby, a magnetic device having approximately the same configuration can be manufactured, and its properties also would be expected approximately the same. However, this method basically needs a winding technology, so that a magnetic device has to be manufactured on a one-by-one basis. Moreover, it is difficult to fill a narrow space between the two first magnetic members 4 with the resin. Therefore, this method cannot improve the manufacturability, which increases the manufacturing cost.

On the contrary, according to the method for manufacturing a magnetic device of the present invention, the sheet-type coil 1 that has been molded in sheet form beforehand is prepared. Next, the first magnetic member 4 is disposed on this sheet-type coil 1. In the case of a configuration where the first magnetic member 4 directly contacts with the sheet-type coil 1, the first magnetic member 4 is formed directly on the sheet-type coil 1 by a method such as sputtering and plating. In the case of a configuration where the second magnetic member 5 is provided, an uncured second magnetic member 5 is disposed at least at one of the center portion and a peripheral portion of the sheet-type coil 1. Next, the first magnetic members 4, which are manufactured separately, are disposed on the upper and lower surfaces of the second magnetic member 4, and then the second magnetic member 5 is cured so as to be integrated as a whole. In the case of a configuration where the adhesive layer 7 is provided, an uncured adhesive layer 7 and the first magnetic member 4 manufactured separately are laminated on the sheet-type coil 1, and then the adhesive layer 7 is cured so as to be integrated as a whole. In the case of a configuration where the adhesive layer 7 covers the outer surface of the first magnetic member 4, the first magnetic member 4 is disposed on the sheet-type coil 1, and then an uncured adhesive layer 7 is laminated thereon. After that, the adhesive layer 7 is cured so as to be integrated as a whole. Since these methods necessarily need neither the winding technology nor the process for filling a narrow space between the two first magnetic members 4 with the resin, the magnetic device can be manufactured easily.

Alternatively, a manufacturing method as shown in FIGS. 15A to 15F also is available. According to this method, first, a large-sized sheet 21 in which a plurality of sheet-type coils 1 are formed is prepared (See FIG. 15A). Next, the insulating substance occupying a center portion 22 of the coil and a predetermined area 23 at a peripheral portion of the coil (hereinafter called "peripheral predetermined area") is removed with a laser machine or the like (See FIG. 15B). Next, uncured second magnetic members 5 are disposed at the portions where the insulating substance was removed (i.e., the center portion 22 and the peripheral predetermined portion 23) (See FIG. 15C). Next, the first magnetic members 4, which has been divided into the respective pieces, are disposed on the upper and lower surfaces of the sheet-type coil 1 on each of which the second magnetic members 5 have been disposed (See FIG. 15D). After that, the second magnetic members 5 are cured so as to bond the first magnetic members 4 and the sheet-type coil 1 together (See FIG. 15E). Then, the large-sized sheet 21 is cut into the individual magnetic devices (See FIG. 15F). Note here that, although FIGS. 15A to 15F illustrate the method for manufacturing the magnetic device shown in FIGS. 3A and 3B using the large-sized sheet, this method also can be applied for manufacturing magnetic devices having the other configurations. In addition, although the first magnetic members 4 divided into the individual pieces beforehand are used in this method, naturally, a large-sized first magnetic member 4 can be disposed as it is, and then this member 4 can be cut together with the large-sized sheet 21. Such a method of utilizing a large-sized sheet, followed by the cutting process into the individual pieces, is applicable to a method of forming the first magnetic member directly by sputtering, plating, and the like.

The conventional method requires a winding method for manufacturing a coil, so that the magnetic device has to be manufactured basically on a one-by-one basis. Therefore, the conventional method has problems of the poor mass-productiveness and a high cost. On the contrary, according to the above-stated method of the present invention, a plurality of magnetic devices can be manufactured at one time by using the large-sized sheet, so that a magnetic device can be mass-manufactured at a low cost.

As a method for disposing the second magnetic members 5, the second magnetic members 5 may be molded in sheet form beforehand, and then such second magnetic members 5 may be disposed on the center portion 22 and the peripheral predetermined area 23 of the sheet-type coil 1. Otherwise, the second magnetic members 5 in paste form may be applied or filled at required portions with a dispenser, a printing method, or the like. Note here that holes are bored beforehand in the portions of the insulating substance for accepting the second magnetic members 5 with a puncher, drill, laser or the like.

In the case of manufacturing a magnetic device provided with the adhesive layer 7, in order to realize a configuration where the second magnetic member 5 and the first magnetic member 4 directly contact with each other as shown in FIG. 8B, holes should be bored in the adhesive layer 7 that has been molded in sheet form beforehand, and the second magnetic members 5 further should be disposed in these holes. In this case, after providing holes in each of the sheet-type coil 1 and the adhesive layer 7 separately and disposing the second magnetic members 5 at each of the holes, both of them may be laminated. Instead, the adhesive layer 7 may be laminated on the sheet-type coil 1 beforehand, holes may be bored in them at one time, and then the second magnetic members 5 may be disposed. Note here that problems would not occur if the order of the step of disposing the first magnetic member 4 and the step of disposing the second magnetic member 5 in the hole are reversed. That is to say, first, holes provided in the sheet-type coil 1 may be filled with the second magnetic member 5, and then the first magnetic member 4 may be disposed on either surface of it. Alternatively, first, one of the first magnetic members 4 may be disposed on one side of the sheet-type coil 1, the holes provided in the sheet-type coil 1 may be filled with the second magnetic members 5, and then the other magnetic member 4 may be disposed on the other side of the sheet-type coil 1. According to the method of the present invention, the second magnetic members 5 can be disposed so as to contact directly with the upper and lower first magnetic members 4 in such a simple manner. This feature can be realized by virtue of the configuration of the present invention, where the coil used in the magnetic device is the sheet-type coil 1 molded in sheet form beforehand where the conductive coil 2 is embedded in the insulating portion 3 made of an insulating resin or the like.

In addition, in the case where a plurality of magnetic devices are manufactured at one time using the large-sized sheet 21, the terminal portion 2*a* of each of the conductive coils 2 may be formed on the same plane as the conductive coil 2. This method is effective because there is no need to carry out the step for forming the terminal portion separately.

Also, in the case where the ferrite sintered element is employed as the first magnetic member 4, a thin ferrite sintered element in the state of a large-sized sheet might be broken. Therefore, the ferrite sintered element should be cut into the individual pieces corresponding to the inductor beforehand. The respective pieces of the ferrite sintered element should be aligned with a mold, a magnet, an adhesive tape or the like, or should be laminated with an adhesive sheet shaped in sheet form beforehand. In the case where the thin metallic magnetic element is employed as the first magnetic member 4, although such a thin metallic magnetic element can be divided into the individual pieces beforehand, the more efficient method is that the thin metallic magnetic element is subjected to some processes in strip form or sheet form with a large area, followed by the cutting process. In the latter case, in order to facilitate the later cutting step, it is preferable to form a pattern by etching or the like in the same manner as in the formation of the slits 6. In the case where the first magnetic members 4 and the sheet-type coil 1 are bonded with the second magnetic member 5 or the adhesive layer 7, a light pressure is applied to the lamination including the respective elements in the direction of lamination while heating so that the second magnetic member 5 or the adhesive layer 7 is cured so as to be integrated as a whole. After that, the large-sized sheet 21 is cut into the individual magnetic devices with a dicing saw or the like.

Furthermore, the conductive coil 2 of the sheet-type coil 1 is formed at a portion of a wiring layer of a wiring board, holes are bored in required positions of the board with a puncher or a laser, these holes are filled with an uncured second magnetic member 5, the first magnetic members 4 are disposed, and then the uncured second magnetic member 5 is cured, so that the magnetic device of the present invention can be formed easily inside of the wiring board or on the surface of the same.

As stated above, according to the method for manufacturing a magnetic device of the present invention, the device can be formed with a simple method in which the sheet-type coil 1 is just sandwiched between the two thin magnetic elements (the first magnetic member 4), and the device can be mass-manufactured at one time, thus reducing the manufacturing cost.

Embodiment 3

The following describes a power supply module equipped with the magnetic device of the present invention.

Figure 16:
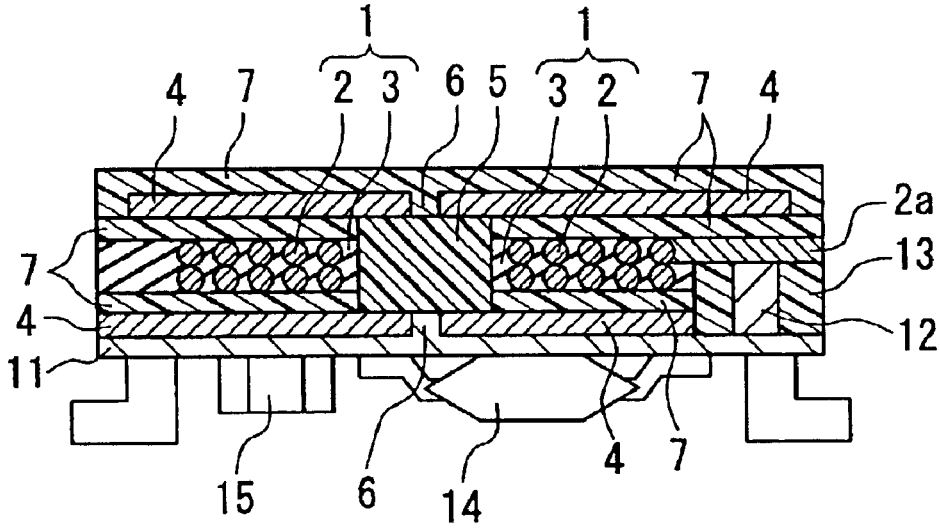
FIG. 16 is a cross-sectional view showing one embodiment of a power supply module according to the present invention.

FIG. 16 shows a configuration of the power supply module equipped with the magnetic device of the present invention. The magnetic device used here is a thin inductor device in which the thin metallic magnetics element with slits 6 is employed as the first magnetic member 4 and both of the second magnetic member 5 and the adhesive layers 7 are provided. The terminal portions 2*a* of the conductive coil 2 have a pattern taking both of the portions out from one side.

This power supply module has a configuration where the thin inductor device is disposed on a wiring board 11 and the wiring board 11 and the terminal portion 2*a* of the thin inductor device are connected with each other through a connecting via 12. The connecting via 12 is provided at a center portion of a resin layer 13. In addition, on the surface of the wiring board 11 opposite to the surface on which the thin inductor device is disposed, a semiconductor chip 14, a chip component 15 such as a control IC and a chip capacitor, and the like are mounted. A portion of the surface without the semiconductor chip 14 and the like mounted thereon is covered with the adhesive layer 7 so as to give an insulating capability to the outer surface of the thin inductor device. By employing the ultra-thin inductor device according to the present invention, this power supply module can realize a small height in spite of the other components (the semiconductor chip 14 and the chip component 15) mounted thereon in the height direction and can realize a small area, because the other components are not present on the surface with the inductor device. Furthermore, the two positions for taking out the terminals of the inductor device can be set at any peripheral position freely, depending on the coil pattern. Therefore, the power supply module of the present invention is not limited to the configuration shown in FIG. 16, and the effect of allowing a high degree of flexibility in design also can be obtained.

EXAMPLES

The following describes specific examples of the magnetic device according to the present invention and the method for manufacturing the same. The following examples 1 to 27 show only the case where an epoxy resin is used as a thermosetting resin. However, as stated above, insofar as exhibiting a binding capability, other resins can produce approximately the same results. As for the thin metallic magnetic element, the following examples show only the case of employing a super-rapid cooling amorphous thin element, which is available readily at a low cost. However, as stated above, other various materials are available, and the material is not limited to this example.

Example 1

As the first magnetic member 4, two Fe base amorphous thin elements of about 4 mm square in size and of 20 μm in thickness were prepared. As the second magnetic member 5, a 14 wt % of epoxy base thermosetting resin (epoxy resin containing bisphenol A as a main ingredient) was mixed with a 96.5 wt % Fe—3.5 wt % Si metallic magnetic powder having an average particle diameter of approximately 10 μm so as to be in paste form. Then, the thus obtained substance was shaped in sheet form by a doctor blade method and was heated and dried at 80° C. for 1 hour, whereby a composite sheet with a thickness of approximately 310 μm was prepared. As the sheet-type coil 1, a double-stacked 18 turns of conductive coil was used by embedding such a coil in an insulating substance and shaping it in sheet form. The conductive coil had an outer diameter of 4.0 mmϕ, an inner diameter of 1.5 mmϕ, a thickness of 300 μm, a wiring diameter of approximately 100 μm, and DC resistance of 170 mΩ and was manufactured by plating. This sheet-type coil was manufactured by coating the conductive coil with the insulating substance having a magnetic permeability smaller than that of the composite sheet used as the second magnetic member 5. In this example, an epoxy resin (epoxy resin containing bisphenol A as a main ingredient) was used as this insulating substance. Also, holes were provided at a center portion and four peripheral portions of the sheet-type coil for accepting the second magnetic member 5.

First, the sheet-type coil was disposed on one of the amorphous thin elements so as to contact directly with each other. Next, the composite sheet stamped out in the same geometry as the holes provided in the sheet-type coil was disposed in the holes, and the other amorphous thin element was laminated thereon. The thus laminated member was heated at 150° C. while applying a light pressure in the lamination direction by means of weights. As a result, the composite sheet was cured so that the amorphous thin elements, the sheet-type coil and the composite were integrated. Thus, an ultra-thin inductor device of 4 mm square in size and of 350 μm in thickness as shown in FIGS. 3A and 3B was manufactured.

As a result of the measurement of the properties of the thus obtained inductance device, the inductance value was 1.7 μH at 1 MHz and the DC superimposition current of 0.5 A. In this way, this inductance device realized not only an ultra-thin configuration and the DC resistance as low as 170 mΩ, but also the high inductance value and the favorable DC superimposition property.

Example 2

As the first magnetic member 4, two MnZn ferrite sintered elements of 10 mm square in size and of 0.5 mm in thickness were prepared. One of them had a protrusion of 4.0 mm in diameter and 0.6 mm in height at its center portion. As the second magnetic member 5, an uncured composite sheet with a thickness of approximately 310 μm was prepared in the same manner as in Example 1. As the sheet-type coil 1, a double-stacked 14 turns of conductive coil was used by embedding the conductive coil in an insulating substance and then shaping it in sheet form. The conductive coil had an outer diameter of 7.5 mmϕ, an inner diameter of 4.5 mmϕ, a thickness of 600 μm, a wiring diameter of approximately 250 μm, and DC resistance of 100 mΩ and was manufactured by plating. The insulating substance used was the same as in Example 1. Also, at the center portion of this sheet-type coil, a hole was provided so as to fit with the protrusion provided on the ferrite sintered element, and at four peripheral portions holes are provided for accepting the second magnetic members 5.

First, the sheet-type coil was disposed on the ferrite sintered element having the protrusion at the center portion so that the protrusion was fitted into the hole provided in the sheet-type coil. Next, the composite sheet stamped out in the same geometry as the holes provided at the peripheral portions of the sheet-type coil was disposed in the holes, and the other ferrite sintered element was laminated thereon. The thus laminated member was heated at 150° C. while applying a light pressure in the lamination direction by means of weights. As a result, the composite sheet was cured so that the ferrite sintered elements, the sheet-type coil and the composite were integrated. Thus, a thin inductor device of 10 mm square in size and of 1.6 mm in thickness as shown in FIGS. 4A and 4B was manufactured.

As a result of the measurement of the properties of the thus obtained inductance device, the inductance value was 45 μH at 1 MHz and the DC superimposition current of 1.0 A. In this way, this inductance device realized not only an ultra-thin configuration and the DC resistance as low as 100 mΩ, but also the high inductance value and the favorable DC superimposition property.

Example 3

As the first magnetic member 4, a NiZn ferrite sintered element with a thickness of 0.2 mm was prepared. As the second magnetic member 5, a 16 wt % of epoxy base thermosetting resin (epoxy resin containing bisphenol A as a main ingredient) was mixed with a carbonyl Fe powder having an average particle diameter of approximately 5 μm so as to be in paste form. As the sheet-type coil 1, a double-stacked 16 turns of conductive coil was used by embedding the conductive coil in an insulating substance and then shaping it in sheet form. The conductive coil had an outer diameter of 2.8 mmϕ, an inner diameter of 0.8 mmϕ, a thickness of 250 μm, a wiring diameter of approximately 100 μm, and DC resistance of 350 mΩ and was manufactured by plating. The insulating substance used was the same as in Example 1. In this example, a large-sized sheet on which a plurality of such sheet-type coils were formed was prepared. The conductive coils had a configuration where its terminal portion was formed in the same plane, and the outer dimensions were within 3 mm×4 mm. An insulating coating surrounding the coil was removed only at the upper and lower surfaces of the coil and at the terminal portion. Holes were formed in this large-sized sheet with a laser machine at a center portion of each sheet-type coil and at four peripheral portions of the same.

First, the plurality of NiZn ferrite sintered elements of 3 mm×4 mm in size were aligned with a mold, a magnet or the like. On these elements, the large-sized sheet with the plurality of sheet-type coils were disposed so as to contact directly with each other. In this step, alignment was carried out so that the respective sheet-type coils and their terminal portions were within the area of the ferrite sintered element. Next, the second magnetic members 5 in paste form were applied and filled in the holes in the large-sized sheet with a printing method using a metallic printing plate. Then, the aligned plurality of ferrite sintered elements of 3 mm×3 mm in size were disposed thereon so as to cover the coil but so that the terminal portions were exposed. The thus laminated member Was heated at 150° C. while applying a light pressure in the lamination direction by means of weights. As a result, the paste was cured so that the ferrite sintered elements, the sheet-type coil and the composite were integrated. Next, the large-sized sheet was cut into the individual thin inductance devices with a dicing-saw. In this way, a plurality of thin magnetic devices of 3 mm×4 mm in size and of 1.0 mm in thickness having the configuration similar to that of the magnetic device shown in FIGS. 3A and 3B could be manufactured at one time by the method similar to that shown in FIGS. 15A to 15F. The inductance value of the thus manufactured inductance device was 4 μH at 1 MHz and the DC superimposition current of 0.2 A. In this way, this inductance device realized not only a ultra-thin configuration and the DC resistance as low as 350 mΩ, but also the high inductance value.

Examples 4 to 9 and Comparative Examples 1

As the first magnetic member 4, a Fe base amorphous thin element (METGLAS-26055C made by Honeywell, Inc.) of 4.5 mm square in size and of 20 μm in thickness and a NiZn ferrite sintered element of 200 μm in thickness were each prepared. As the second magnetic member 5, 18 wt % of liquid epoxy resin (epoxy resin containing bisphenol A as a main ingredient) was mixed with a 96.5 wt % Fe—4 wt % Si—4 wt % Cr metallic magnetic powder having an average particle diameter of approximately 16 μm so as to be in paste form. As the adhesive layer 7, 17 wt % of powder form epoxy resin (epoxy resin containing bisphenol A as a main ingredient), 8 wt % of liquid form epoxy resin (epoxy resin containing bisphenol A as a main ingredient) and a solvent were mixed with an alumina powder having an average particle diameter of 3 μm so as to be in paste form. This was shaped in sheet form by a doctor blade method and was heated and dried at 80° C. for 1 hour, whereby a sheet for an adhesive layer with flexibility and a thickness of approximately 30 μm was prepared. As the sheet-type coil 1, a double-stacked 18 turns of conductive coil was used by embedding such a coil in an insulating substance and shaping it in sheet form. The conductive coil had an outer diameter of 4.0 mmϕ, an inner diameter of 0.5 mmϕ, a thickness of 300 μm, a wiring diameter of approximately 100 μm, and DC resistance of 250 mΩ and was manufactured by plating. Using these elements, the following magnetic devices in Examples 4 to 9 and Comparative Example 1 were manufactured.

(1) Example 4

The sheets for adhesive layer were laminated on the upper and lower surfaces of the sheet-type coil. Moreover, the amorphous thin elements were laminated thereon. The thus laminated member was heated at 150° C. while applying a light pressure in the lamination direction by means of weights, so that the sheets for adhesive layer were cured. In this way, a thin magnetic device having the configuration in cross-section similar to that shown in FIG. 5B was manufactured.

(2) Example 5

Holes were formed at a center portion and four peripheral portions of the sheet-type coil, and then the holes were filled with a paste formed as the second magnetic member 5. Subsequently, in the same manner as in Example 4, the sheets for the adhesive layer and the amorphous thin elements were laminated on the upper and lower surfaces of the sheet-type coil, followed by processes of applying a pressure and heat so as to cure the second magnetic member 5 and the adhesive layer 7. In this way, a thin magnetic device provided with the second magnetic member 5 and the adhesive layer 7, where the adhesive layer 7 was located between the first magnetic member 4 and the second magnetic member 5, was manufactured.

(3) Example 6

The sheets for adhesive layer were laminated on the upper and lower surfaces of the sheet-type coil, holes were bored at the center portion and four peripheral portions of the sheet-type coil so as to penetrate also the sheets for adhesive layer, and the holes were filled with a paste as the second magnetic member. Subsequently, the amorphous thin elements were laminated on the upper and lower surfaces of the sheet-type coil on which the sheets for adhesive layer have been laminated, followed by processes of applying a pressure and heat so as to cure the second magnetic member and the sheets for adhesive layer. In this way, a thin magnetic device having the configuration in cross-section similar to that shown in FIG. 11B was manufactured.

(4) Example 7

A magnetic device with the same configuration as in Example 4 was manufactured with the same materials and methods employed in those of Example 4, except that the ferrite sintered element was used instead of the amorphous thin element. The size was 4.5 mm square.

(5) Example 8

A magnetic device with the same configuration as in Example 5 was manufactured with the same materials and methods employed in those of Example 5, except that the ferrite sintered element was used instead of the amorphous thin element. The size was 4.5 mm square.

(6) Example 9

A magnetic device with the same configuration as in Example 6 was manufactured with the same materials and methods employed in those of Example 6, except that the ferrite sintered element was used instead of the amorphous thin element. The size was 4.5 mm square.

(7) Comparative Example 1

As the comparative example 1, a magnetic device including only the sheet-type coil was prepared.

Inductance values of the magnetic devices in the above Examples 4 to 9 and the Comparative Example 1 were measured at the frequency of 100 kHz and the DC superimposition current of 0 A and at the frequency of 1 MHz and the DC composition current of 0.5 A. The decreasing rate thereof also was measured. Further, the thickness of each magnetic device also was measured. The results were listed in the following Table 1.

TABLE 1

| | first magnetic member | thickness (mm) | inductance value (μH) DC superimposition current 0A | DC superimposition current 0.5A | decreasing rate (%) |
|---|---|---|---|---|---|
| Ex.4 | amorphous | 0.40 | 2.14 | 2.11 | 1.4 |
| Ex.5 | thin | 0.40 | 3.08 | 2.38 | 22.7 |
| Ex.6 | element | 0.40 | 3.46 | 2.47 | 28.6 |
| Ex.7 | ferrite | 0.76 | 3.66 | 3.66 | 0 |
| Ex.8 | sintered | 0.76 | 4.76 | 4.71 | 1.1 |
| Ex.9 | element | 0.76 | 5.22 | 5.15 | 1.3 |
| Com.1 | none | 0.30 | 0.87 | 0.87 | 0 |

As shown in Table 1, the magnetic devices in Examples 4 to 6 were small and thin, because they were not so thick compared with Comparative Example 1 including the coil only, and these devices had large inductance values and relatively favorable DC superimposition properties. When comparing three types of magnetic devices (i.e., (Type 1) Examples 4 and 7, (Type 2) Examples 5 and 8, and (Type 3) Examples 6 and 9), their inductance values were increased in ascending order of these types i.e., the order of 1 to 3). Meanwhile, the DC superimposition properties were more favorable in descending order of these types. When comparing between the amorphous thin element and the ferrite sintered element, the amorphous thin element could realize a thinner device, but the ferrite sintered element could realize more favorable inductance value and DC superimposition property. Therefore, the configuration and the materials used should be selected depending on the intended application.

Examples 10 to 27 and Comparative Example 2

As the first magnetic member 4, two types of super-rapid cooling Co—Fe—Ni—B base amorphous thin elements (METGLAS-2714A made by Honeywell, Inc.) of 3.0 mm square in size and of 20 μm and 30 μm in thickness were prepared. Also, members obtained by etching these amorphous thin elements with nitric acid into a thickness of 10 μm also were prepared. Then, various patterns of slits of 100 μm in width were formed in these amorphous thin elements by etching using a mask. Further, a NiZn ferrite sintered element of 3.0 mm square in size and of 200 μm in thickness was prepared. As the second magnetic member 5, 16 wt % of liquid epoxy resin (epoxy resin containing bisphenol A as a main ingredient) was mixed with a 95 wt % Fe—5 wt % Si metallic magnetic powder having an average particle diameter of approximately 20 μm so as to be in paste form. As the adhesive layer 7, sheets for adhesive layer formed by applying an epoxy resin (epoxy resin containing bisphenol A as a main ingredient) on both faces of a polyimide resin tape with a thickness of 5 μm were prepared. As the sheet-type coil 1, a double-stacked 19.5 turns of conductive coil was prepared, where the conductive coil had an outer diameter of 2.8 mmϕ, an inner diameter of 0.5 mmϕ, a wiring diameter of approximately 80 μm, and DC resistance of 300 mΩ and was manufactured by plating. Then, the sheet-type coil was manufactured by binding this conductive coil with a thermosetting resin (epoxy resin containing bisphenol A as a main ingredient) so as to be hardened in sheet form. The outer dimensions of this sheet-type coil excluding the terminal portion were 3 mm square in size and 240 μm in thickness.

The sheets for adhesive layer were laminated on the upper and lower surfaces of the sheet-type coil, holes were bored at the center portion and four peripheral portions of the sheet-type coil so as to penetrate also the sheets for adhesive layer, and the holes were filled with an uncured paste for forming the second magnetic member 5. Subsequently, members used as the first magnetic members 4 further were laminated on the upper and lower surfaces of the sheet-type coil on which the sheets for adhesive layers have been laminated, followed by processes of applying a light pressure with weights and heat at 160° C. so as to cure the sheets for the adhesive layer and the paste. In this way, a thin magnetic device having the configuration in cross-section similar to that shown in FIG. 11B was manufactured. In the case where a lamination of thin metallic magnetics elements is used as the first magnetic member 4, the sheets for adhesive layer further were laminated on the upper and lower surfaces of this magnetic device, and a light pressure by means of weights and heat at 160° C. were applied to the thus obtained lamination, so that the sheets for adhesive layer were cured. Thereby, a thin magnetic device having the configuration in cross-section similar to that of the magnetic device shown in FIG. 8B was manufactured. Using these elements, the following magnetic devices in Examples 10 to 27 and Comparative Example 2 were manufactured. As the comparative example 2, a magnetic device including only the sheet-type coil was prepared. Table 2 shows the configurations of the magnetic devices in Examples 10 to 27 and Comparative Example 2 and the properties of these magnetic devices as the measurement results at the frequency of 100 kHz and the DC superimposition current of 0 A, at the frequency of 1 MHz and the DC composition current of 0 A and at the frequency of 1 MHz and the DC composition current of 0.5 A.

TABLE 2

| No. | 1st magnetic member upper | 1st magnetic member lower | thickness of 1st magnetic member (micron) | slit*1 | 2nd magnetic member | remarks | total thickness (mm) | L/R (micronH/ohm) 100 kHz,0A | L/R (micronH/ohm) 1 MHz,0A | L/R (micronH/ohm) 1 MHz,0.5A | L/R 1 MHz,0A |
|---|---|---|---|---|---|---|---|---|---|---|---|
| 10 | thin element/sgl. layer | thin element/sgl. layer | 20 | absence | absence | — | 0.29 | 2.3/0.5 | 2.1/3.0 | 1.9/2.8 | 0.70 |
| 11 | thin element/sgl. layer | thin element/sgl. layer | 20 | absence | presence | — | 0.29 | 3.8/0.7 | 3.3/6.0 | 1.0/1.2 | 0.55 |
| 12 | thin element/sgl. layer | thin element/sgl. layer | 20 | presence/X | absence | — | 0.29 | 2.1/0 4 | 2.0/2.0 | 1.8/1.9 | 1.00 |
| 13 | thin element/sgl. layer | thin element/sgl. layer | 20 | presence/X | presence | 0.26 | 3 6/0 5 | 3.1/4.0 | 0.9/0.7 | 078 | |
| 14 | thin element/2 layers | thin element/2 layers | 20/20 | absence | presence | — | 0.36 | 4.2/0.6 | 3.7/7.6 | 2.5/4.2 | 0.49 |
| 15 | thin element/2 layers | thin element/2 layers | 20/20 | presence/– | presence | — | 0.36 | 3.9/0 5 | 3.5/3.4 | 2.0/1.9 | 1 03 |
| 16 | thin element/2 layers | thin element/2 layers | 20/20 | presence/X | presence | — | 0.36 | 3.7/0.5 | 3.4/3 2 | 2.0/1.8 | 1.06 |
| 17 | thin element/2 layers | thin element/2 layers | 20/20 | presence/* | presence | — | 0.36 | 3.5/0 5 | 3.3/3 0 | 2.0/1.7 | 1.10 |
| 18 | thin element/3 layers | thin element/3 layers | 20/20/20 | presence/X | presence | — | 0.43 | 4.0/0.53.6/3 1 | 2.3/2 8 | 1 16 | |
| 19 | thin element/2 layers | thin element/2 layers | 10/10 | presence/X | presence | — | 0.32 | 4.4/0.6 | 4.1/3.4 | 0.8/0.7 | 1.21 |
| 20 | thin element/3 layers | thin element/3 layers | 10/10/10 | presence/X | presence | — | 0.37 | 4.6/0.6 | 4.3/35 | 1.9/1.8 | 1.23 |
| 21 | thin element/2 layers | thin element/2 layers | 20/20 | presence/FIG.8A | presence | — | 0.36 | 3.9/0.4 | 3 6/3.3 | 2.0/1.7 | 1.09 |
| 22 | thin element/2 layers | thin element/2 layers | 20/20 | presence/FIG.9A | presence | — | 0.36 | 3.9/0.4 | 3.6/3.4 | 2.0/1 7 | 1.06 |
| 23 | thin element/2 layers | thin element/2 layers | 10/30 | presence/FIG.10A | presence | — | 0.36 | 4.7/0.5 | 4.3/3.8 | 2.1/1.9 | 113 |
| 24 | thin element/sgl. layer | thin element/sgl. layer | 20 | presence/x | presence(slits also filled) | — | 0.26 | 3.8/0.5 | 3.3/4 0 | 1.1/0.7 | 0.83 |
| 25 | thin element/sgl. layer | thin element/sgl. layer | 20 | presence/X | presence | *2 | 0.26 | 3.7/0.4 | 3.2/3.5 | 0.9/0 6 | 0.91 |
| 26 | ferrite | thin element/2 layers | 20/200 | presence/X (FIG.13A) | presence | — | 0.46 | 3.8/0.5 | 3 6/2 9 | 2.3/2.0 | 1.24 |
| 27 | ferrite | ferrite | 200/200 | — | presence | — | 0.62 | 4.3/0.5 | 4.2/1 5 | 3.7/1.3 | 2.80 |
| Com.2 | none | none | — | — | absence | — | 0.22 | 0 64/0.4 | 0 63/0.4 | 0.63/0.4 | 1.58 |

*1presence or absence/shape
*2thin element is subjected to heat treatment

In Table 2, "x" denotes the same slit pattern as in the magnetic device shown in FIG. 5A, "-" denotes a slit pattern including only the lateral slits and not the longitudinal slits of the magnetic device shown in FIG. 6A, and "*" denotes a combination of the slit patterns shown in FIG. 5A and shown in FIG. 6A. In addition, a letter L denotes an inductance value and a letter R denotes AC resistance. The term "thin element" represents an amorphous thin element and the term "ferrite" represents a ferrite sintered element.

Comparative Example 2 shows the configuration including the sheet-type coil only, whose value of L was considerably small. When laminating the amorphous thin elements without slits on the upper and lower surfaces of this sheet-type coil via the adhesive layer 7, then the value of L was improved to some extent (Example 10). When disposing the second magnetic member 5 at the center portion of the coil, then the value of L was improved further (Example 11). However, the AC resistance values at 1 MHz of these devices were large. Compared with these Examples 10 and 11, according to the magnetic devices in Examples 12 and 13 having the configuration similar to those of the magnetic devices in FIGS. 5A and 6A, where the amorphous thin element was divided by slits, the value of L was not decreased so much but the AC resistance at 1 MHz could be decreased. However, both of the values of L at 1 MHz and 0.5 A of these magnetic devices were lower than those at 1 MHz and 0 A, and therefore their DC superimposition properties were not favorable sufficiently.

According to the magnetic device in Example 14, which was not provided with slits but included double layered amorphous thin elements with an insulating layer intervening therebetween, the value of L was increased and the DC superimposition property also was improved, compared with Example 11 including a single layer of amorphous thin element. However, the AC resistance at 1 MHz thereof was a considerably large value. On the other hand, according to the magnetic devices in Examples 15 to 17, where the amorphous thin elements were divided by slits, the values of L were decreased slightly, but their AC resistance values were decreased to a half or less. In this way, with increasing the number of division of the amorphous thin element, the AC resistance was decreased, but the value of L also was decreased slightly.

According to Example 18 including the lamination of triple layered amorphous thin elements, the DC superimposition property was improved further, and the values of L and the AC resistance also were improved slightly. However, the thickness of the samples exceeded 0.4 mm. According to the magnetic devices in Examples 19 and 20 including the lamination of double or triple layered amorphous thin elements, where the thickness of the amorphous thin elements was reduced to 10 $\mu$m by etching, the DC superimposition property was decreased compared with the magnetic devices in Examples 16 and 18, but the value of L was increased and the AC resistance was improved further, where the value of L/the AC resistance at 1 MHz and 0 A was the highest among the devices employing the amorphous thin elements.

The magnetic devices in Examples 21, 22, and 23 had the same configurations as in FIG. 8, 9, and 10, respectively. Compared with the magnetic device in Example 16 whose slit positions in the inner and outer two amorphous thin layers coincided with each other, the magnetic device in Example 21 whose slit positions were different between the inner and outer elements and the magnetic device in Example 22 without slits in the outer element had approximately the same AC resistance, but their values of L were slightly large. The magnetic device in Example 23 whose inner layer was thin and the outer layer was thick had a large value of L but a small AC resistance.

The magnetic device in Example 24 had the same configuration as in the magnetic device in Example 13, except that the slits were filled with the second magnetic member. As a result, other properties were almost the same.

The magnetic device in Example 25 also had the same configuration as in the magnetic device in Example 13, except that the amorphous thin elements subjected to heating treatment for 1 hour was used. By the heating treatment, the value of L was improved slightly and the AC resistance was decreased considerably, so that favorable properties could be obtained. As a result of the examinations using the thin amorphous elements having various components on the effects of the heat processing temperatures by the inventors, the heat treatment at less than 300° C. hardly changed the properties in any cases. However, with the heat treatment at temperatures exceeding the crystallization temperature, the properties deteriorated. Therefore, it was confirmed that a heat treatment temperature in the range of 300° C. to the crystallization temperature inclusive was preferable.

The magnetic device in Example 26 was provided with one side made of the ferrite sintered element. As for this device, all of the value of L, the AC resistance, and the DC superimposition property were excellent, but naturally the thickness was large.

The magnetic device in Example 27 had a configuration using the ferrite sintered element only. It was confirmed that all of the value of L, the AC resistance and the DC superimposition property were more favorable than in the device using the amorphous thin element. However, the thickness of the device was as thick as 0.64 mm.

As stated above, the magnetic devices in Examples 10 to 25 using the amorphous thin element had the advantage of a small thickness compared with the magnetic device using the ferrite sintered element. Particularly, according to the magnetic devices in Examples 16 to 25 including the combination of the amorphous thin elements with slits, their lamination and the second magnetic members, their values of L were not much different from that of the magnetic device in Example 27, and the AC resistance and the DC superimposition properties were just inferior slightly.

Next, an AC current at 1 MHz was fed to the magnetic devices in Examples 11, 13, 16, 17, 21, 22 and 24 and a search coil for measurement was disposed on the top surface of the magnetic devices, so that the leakage noise was measured at 5 MHz. As a result of the measurement, the noise was 18.0 dB, 24.0 dB, 23.5 dB, 24.5 dB, 17.8 dB, 17.6 dB and 20.4 dB, respectively. From these results, the slits provided in the thin metallic magnetics element could decrease the magnetic loss and the AC resistance, but increased the noise level (Examples 11 and 13). The lamination of the thin metallic magnetic element having slits located at the same position did not change the increase in the noise level so much (Example 16), and the noise level increased with increasing the number of slits (Example 17). On the contrary, according to the magnetic device in Example 21 having the slits located at displaced positions and the magnetic device in Example 22 without slits in the outer amorphous thin element, the noise was decreased remarkably, so that a favorable effect could be confirmed.

Next, these magnetic devices were mounted on the board, and a drop test was performed from the height of 1.8 m with respect to these devices to which a spindle was attached. As a result of the test, fractures occurred in the ferrite sintered elements of some devices using the ferrite sintered element and their L values were decreased, but almost no change was confirmed in the devices using the amorphous thin element only.

Example 28

A power supply module having the configuration shown in FIG. 16 was manufactured using the magnetic device according to the present invention. That is to say, a resin layer including a connective via was formed at the terminal portion of the magnetic device, and this was mounted on a wiring board by soldering. On the opposite surface of the wiring board, a control IC, a chip capacitor and the like were mounted so as to make up the power supply module. By employing the ultra-thin inductor device, this power supply module can realize a small height in spite of the other components mounted thereon in the height direction and can realize a small area, because the other components are not present on the surface with the inductor device. Furthermore, the two positions for taking out the terminals of the inductor device can be set at any peripheral position freely, depending on the coil pattern, and therefore a high degree of flexibility in design can be obtained.

As stated above, the magnetic device according to the present invention is small and thin, and has a configuration where the magnetic flux does not traverse the coil conductor. Therefore, the magnetic device can reduce the magnetic loss even at high frequencies and can realize a large inductance, a small coil DC resistance, and a favorable DC superimposition property.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A magnetic device comprising:

a sheet-type coil including a planar conductive coil and an insulating substance; and a first magnetic member in sheet form disposed on at least one of upper and lower surfaces of the sheet-type coil, wherein a magnetic permeability of the insulating substance is smaller than a magnetic permeability of the first magnetic member.

2. The magnetic device according to claim 1 further comprising:

a second magnetic member made of a resin containing a magnetic powder and having a magnetic permeability larger than that of the insulating substance and smaller than that of the first magnetic member, wherein the second magnetic member is disposed at least in one position selected from a center portion and a peripheral portion of the sheet-type coil where a conductor constituting the planar conductive coil is not present.

3. The magnetic device according to claim 2, wherein the first magnetic member comprises a metallic magnetic element with a thickness of 30 μm or less or a lamination including a metallic magnetic element with a thickness of 30 μm or less and an insulating layer, and a slit is provided at least in one position of the metallic magnetic element on and under which the second magnetic member is not provided and in a direction intersecting a winding direction of a conductor constituting the planar conductive coil.

4. The magnetic device according to claim 3, wherein a third magnetic member having an insulating capability is disposed at least in one portion of the slit.

5. The magnetic device according to claim 4, wherein the third magnetic member is made of the same material as that of the second magnetic member.

6. The magnetic device according to claim 3, wherein the slit is provided so as not to completely divide the metallic magnetic element into two or more pieces.

7. The magnetic device according to claim 2, wherein the magnetic powder is a metallic magnetic powder.

8. The magnetic device according to claim 1, wherein the first magnetic member comprises at least one selected from a ferrite sintered element, a dust core, a metallic magnetic element with a thickness of 30 μm or less, and a lamination including a metallic magnetic element with a thickness of 30 μm or less and an insulating layer.

9. The magnetic device according to claim 8, wherein the metallic magnetic element is an amorphous thin element.

10. The magnetic device according to claim 9, wherein the amorphous thin element is subjected to heat treatment at a temperature ranging from 300° C. to a crystallization temperature, inclusive.

11. The magnetic device according to claim 1, wherein a protrusion is provided at a position of the first magnetic member, corresponding to a center portion or a peripheral portion of the sheet-type coil.

12. The magnetic device according to claim 1, wherein the first magnetic member comprises a lamination in which two or more layers of metallic magnetic elements with a thickness of 30 μm or less are laminated with an insulating layer intervening therebetween, a slit is provided at least in one position of at least one layer of the metallic magnetic elements, and the provided slits are located so as not to overlap among all of the layers of the metallic magnetic elements.

13. The magnetic device according to claim 1, wherein the first magnetic member comprises a lamination in which two or more layers of metallic magnetic elements with a thickness of 30 μm or less are laminated with an insulating layer intervening therebetween, a slit is provided at least in one position of at least one layer of the metallic magnetic elements, and a total length of slits in one metallic magnetic element layer increases with increasing proximity of the metallic magnetic element layer to the sheet-type coil.

14. The magnetic device according to claim 1, wherein the first magnetic member comprises a metallic magnetic element with a thickness of 30 μm or less or a lamination including a metallic magnetic element with a thickness of 30 μm or less and an insulating layer, and a slit is provided at least in one position of the metallic magnetic element and in a direction intersecting a winding direction of a conductor constituting the planar conductive coil.

15. The magnetic device according to claim 14, wherein a third magnetic member having an insulating capability is disposed at least in one portion of the slit.

16. The magnetic device according to claim 14, wherein the slit is provided so as not to completely divide the metallic magnetic element into two or more pieces.

17. The magnetic device according to claim 1, wherein the conductive coil is configured with a double-stacked coil in which upper and lower coils wound in planar form are connected with each other at their most inner turns.

18. The magnetic device according to claim 1, wherein the outer shape of the conductive coil is one of circular, elliptical and oval.

19. The magnetic device according to claim 1, wherein the sheet-type coil is provided as a part of a wiring layer of a wiring board and inside of or on a surface of the wiring board.

20. The magnetic device according to claim 1, further comprising:

an adhesive layer provided between the first magnetic member and the sheet-type coil.

21. A power supply module comprising:

a wiring board, and a magnetic device that comprises a sheet-type coil including a planar conductive coil and an insulating substance; and a first magnetic member in sheet form disposed on at least one of upper and lower surfaces of the sheet-type coil, where a magnetic permeability of the insulating substance is smaller than a magnetic permeability of the first magnetic member, and the magnetic device is connected electrically with the wiring board.

22. A method for manufacturing a magnetic device, comprising the steps of:

(a) preparing a sheet-type coil including a planar conductive coil and an insulating substance; and (b) disposing a first magnetic member in sheet form having a magnetic permeability larger than that of the insulating substance on at least one of upper and lower surfaces of the sheet-type coil.

23. The method for manufacturing a magnetic device according to claim 22, wherein in the step (a) a hole is formed at a predetermined area of the sheet-type coil so as to penetrate the upper and lower surfaces of the sheet-type coil, where the predetermined area is at least one position selected from a center portion and a peripheral portion of the sheet-type coil where a conductor constituting the planar conductive coil is not present, and in the step (b) a second magnetic member in an uncured state is disposed in the hole formed in the sheet-type coil, the second magnetic member being made by mixing a magnetic powder and an uncured resin, and the sheet-type coil and the first magnetic member are integrated with each other by curing the second magnetic member.

24. The method for manufacturing a magnetic device according to claim 23, wherein in the step (b) the first magnetic member is disposed beforehand on at least one of the upper and lower surfaces of the sheet-type coil, the second magnetic member in an uncured state is disposed in the hole formed in the sheet-type coil, another first magnetic member is disposed on the other surface between the upper and lower surfaces of the sheet-type coil, and then the sheet-type coil and the first magnetic members are integrated with each other by curing the second magnetic member.

25. The method for manufacturing a magnetic device according to claim 22, wherein in the step (a) a large-sized sheet with a plurality of sheet-type coils provided thereon is prepared, in the step (b) the first magnetic member is disposed on at least one of upper and lower surfaces of individual sheet-type coils, and the method further comprises the step of:

(c) cutting the large-sized sheet so as to form an individual magnetic device.

26. The method for manufacturing a magnetic device according to claim 25, wherein in the step (a) a hole is formed at a predetermined area of the sheet-type coil so as to penetrate the upper and lower surfaces of the sheet-type coil, where the predetermined area is at least one position selected from a center portion and a peripheral portion of the sheet-type coil where a conductor constituting the planar conductive coil is not present, and in the step (b) a second magnetic member in an uncured state is disposed in the hole formed in the sheet-type coil, the second magnetic member being made by mixing a magnetic powder and an uncured resin, and the sheet-type coil and the first magnetic member are integrated with each other by curing the second magnetic member.

27. The method for manufacturing a magnetic device according to claim 26, wherein in the step (b) the first magnetic member is disposed beforehand on at least one of the upper and lower surfaces of the sheet-type coil, the second magnetic member in an uncured state is disposed in the hole formed in the sheet-type coil, another first magnetic member is disposed on the other surface between the upper and lower surfaces of the sheet-type coil, and then the sheet-type coil and the first magnetic members are integrated with each other by curing the second magnetic member.

* * * * *

UNITED STATES PATENT AND TRADEMARK OFFICE

CERTIFICATE OF CORRECTION

PATENT NO. : 6,768,409 B2
DATED : July 27, 2004
INVENTOR(S) : Inoue et al.

It is certified that error appears in the above-identified patent and that said Letters Patent is hereby corrected as shown below:

Title page,
Item [56], References Cited, FOREIGN PATENT DOCUMENTS, "JP 3-284808 12/1981" should read -- JP 3-284808 12/1991 --

Signed and Sealed this

Twenty-second Day of February, 2005

JON W. DUDAS
*Director of the United States Patent and Trademark Office*